US011518015B2

(12) United States Patent
Rakaczki et al.

(10) Patent No.: US 11,518,015 B2
(45) Date of Patent: Dec. 6, 2022

(54) SWITCHING DEVICE FOR A HAMMER DRILL AND HAMMER DRILL COMPRISING A SWITCHING DEVICE

(71) Applicant: Robert Bosch GmbH, Stuttgart (DE)

(72) Inventors: Janos Rakaczki, Miskolc (HU); Thomas Duerr, Asperg (DE); Carla-Maria Finck, Stuttgart (DE); Ulrich Bohne, Kohlberg (DE); Andras Markovics, Boldva (HU)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/266,043

(22) PCT Filed: Aug. 8, 2019

(86) PCT No.: PCT/EP2019/071318
§ 371 (c)(1),
(2) Date: Feb. 4, 2021

(87) PCT Pub. No.: WO2020/038728
PCT Pub. Date: Feb. 27, 2020

(65) Prior Publication Data

US 2021/0308854 A1 Oct. 7, 2021

(30) Foreign Application Priority Data

Aug. 21, 2018 (DE) ..... 10 2018 214 092.8

(51) Int. Cl.
*B25B 21/02* (2006.01)
*B25D 16/00* (2006.01)

(52) U.S. Cl.
CPC ..... *B25D 16/006* (2013.01); *B25B 21/02* (2013.01); *B25D 16/003* (2013.01); (Continued)

(58) Field of Classification Search
CPC .... B25B 21/02; B25D 16/003; B25D 16/006; B25D 2216/0092; B25D 2250/095; B25D 2250/265
See application file for complete search history.

(56) References Cited

U.S. PATENT DOCUMENTS 4,204,580 A * 5/1980 Nalley ..... B25D 16/006 200/522
4,428,438 A * 1/1984 Holzer ..... B25B 21/00 173/48

(Continued)

FOREIGN PATENT DOCUMENTS

CN 101903133 A 12/2010
CN 108367421 A 8/2018

(Continued)

OTHER PUBLICATIONS

International Search Report corresponding to PCT Application No. PCT/EP2019/071318, dated Oct. 31, 2019 (German and English language document) (5 pages).

*Primary Examiner* — Thanh K Truong
*Assistant Examiner* — David G Shutty
(74) *Attorney, Agent, or Firm* — Maginot, Moore & Beck LLP

(57) ABSTRACT

The disclosure relates to a switching device for a hammer drill, having a manually actuatable switching element. It is proposed that the switching element is designed for actuating an operational mode switching unit and a switching unit for changing the direction of rotation.

14 Claims, 13 Drawing Sheets

(52) U.S. Cl.
CPC ..... *B25D 2216/0092* (2013.01); *B25D 2250/095* (2013.01); *B25D 2250/265* (2013.01)

(56) References Cited

U.S. PATENT DOCUMENTS

| | | | | | |
|---|---|---|---|---|---|
| 4,825,961 | A * | 5/1989 | Neumaier | B25D 16/006 | 173/109 |
| 5,842,527 | A * | 12/1998 | Arakawa | B25D 16/006 | 173/104 |
| 6,431,289 | B1 * | 8/2002 | Potter | F16H 3/66 | 475/299 |
| 6,460,627 | B1 * | 10/2002 | Below | B25D 16/006 | 173/48 |
| 7,331,496 | B2 * | 2/2008 | Britz | B25D 16/006 | 74/22 A |
| 7,891,438 | B2 * | 2/2011 | Ullrich | B25D 16/006 | 173/171 |
| 8,555,998 | B2 * | 10/2013 | Schroeder | B25D 16/006 | 173/90 |
| 8,851,201 | B2 * | 10/2014 | Limberg | B25F 5/001 | 173/178 |
| 9,463,563 | B2 * | 10/2016 | Takeuchi | B25D 16/006 | |
| 9,687,977 | B2 * | 6/2017 | Papp | B25F 5/001 | |
| 9,878,434 | B2 * | 1/2018 | Hecht | B25D 16/003 | |
| 10,245,717 | B2 * | 4/2019 | Schenk | G05G 9/00 | |
| 10,994,403 | B2 * | 5/2021 | Bantie | B25F 5/001 | |
| 11,034,012 | B2 * | 6/2021 | Fuchs | B25F 5/00 | |
| 2003/0121678 | A1 | 7/2003 | Manschitz et al. | | |
| 2005/0224242 | A1 | 10/2005 | Britz et al. | | |
| 2006/0201688 | A1 * | 9/2006 | Jenner | B25B 23/14 | 173/48 |
| 2009/0065228 | A1 * | 3/2009 | Hashimoto | B23B 31/005 | 173/48 |
| 2009/0194305 | A1 * | 8/2009 | Xu | B25D 16/006 | 173/48 |
| 2013/0327552 | A1 * | 12/2013 | Lovelass | B25B 23/147 | 173/1 |
| 2013/0333907 | A1 * | 12/2013 | Hecht | B25B 23/141 | 173/48 |
| 2015/0122524 | A1 * | 5/2015 | Papp | B25B 21/00 | 173/20 |
| 2016/0207187 | A1 * | 7/2016 | Nishikawa | B25D 16/00 | |
| 2017/0368673 | A1 * | 12/2017 | Kunz | B25D 11/12 | |
| 2018/0361559 | A1 * | 12/2018 | Bantle | B25D 16/003 | |
| 2018/0370011 | A1 * | 12/2018 | Bantie | B25F 5/001 | |

FOREIGN PATENT DOCUMENTS

| | | | | | |
|---|---|---|---|---|---|
| DE | 103 55 812 | A1 | | 6/2005 | |
| DE | 10 2004 055 236 | A1 | | 5/2006 | |
| DE | 10 2012 212 417 | A1 | | 2/2014 | |
| EP | 0 211 801 | A1 | | 2/1987 | |
| EP | 3 040 164 | A1 | | 7/2016 | |
| EP | 3 222 389 | A1 | | 9/2017 | |
| GB | 2 408 476 | A | | 6/2005 | |
| GB | 2408476 | B | * | 1/2006 | B25D 16/006 |

* cited by examiner

SWITCHING DEVICE FOR A HAMMER DRILL AND HAMMER DRILL COMPRISING A SWITCHING DEVICE

This application is a 35 U.S.C. § 371 National Stage Application of PCT/EP2019/071318, filed on Aug. 8, 2019, which claims the benefit of priority to Serial No. DE 10 2018 214 092.8, filed on Aug. 21, 2018 in Germany, the disclosures of which are incorporated herein by reference in their entirety.

BACKGROUND

A hand-held power tool having a switching element and a rotational-direction switchover element that are realized separately from each other is described in DE 10 2012 212 417.

SUMMARY

The disclosure relates to a switchover device for a hammer drill, having a manually actuatable switchover element. It is proposed that the switchover element be designed to actuate an operating-mode switchover unit and a rotational-direction switchover unit. In this way it is possible, advantageously, to achieve particularly convenient operation and a compact structure of the hammer drill.

A "manually actuatable" switchover element is to be understood to mean, in particular, a switchover element that is actuated by means of a movement, or force in the form of a movement of the switchover element, exerted by a user of the hand-held power tool. The switchover element may be realized as a single piece or as a single part. "As a single piece", in the context of this application, is to be understood to mean, in particular, a component composed of or made from one piece. "as a single part", in the context of this application, is to be understood to mean, in particular, a plurality of components combined by means of a material bond to form a single component.

In particular, the switchover element is mounted in a linearly movable and/or rotatable manner in a housing of the hammer drill. Preferably, the switchover element has only a single rotational degree of freedom and no linear degree of freedom. The switchover element may be arranged in such a manner that it can be actuated directly, in particular touched, by a user. Alternatively, it is also conceivable for the switchover element to be connected to one or more other components, in particular an operating element, in such a manner that the switchover element can be actuated indirectly via the operating element.

The hammer drill is realized, in particular, as a portable hand-held power tool. The hammer drill has at least one first operating mode, in which an insert tool that is connected to the hammer drill is driven in rotation, and at least one second operating mode, in which the insert tool is driven in a linearly oscillating, or percussive, manner. The hammer drill preferably has a pneumatic percussion mechanism.

The operating-mode switchover unit is designed to switch over an operating mode of the hammer drill. In particular, the operating-mode switchover unit can be actuated by the switchover element in such a manner that the operating-mode switchover unit can be switched between at least two switching positions. Preferably, the operating-mode switchover unit is designed for switching over two operating modes, preferably at least three operating modes. An operating mode in this context is to be understood to mean, in particular, a drilling mode, a screwdriving mode, a hammer-drilling mode or a chiseling mode. Preferably, the operating modes differ only in the type of drive motion transmitted to the insert tool, for example purely rotational, rotational and linearly oscillating, purely linearly oscillating. Optionally or additionally, the operating mode may also differ in an applied torque, a rotational speed or a percussive force. In particular, the operating mode is non-dependent on a direction of rotation of the insert tool.

The rotational-direction switchover unit is designed for switching over a direction of rotation of the hammer drill. In particular, the rotational-direction switchover unit can be actuated by the switchover element in such a manner that the rotational-direction switchover unit can be switched between two directions of rotation. Preferably, the rotational-direction switchover unit is designed to switch over the direction of rotation in a single operating mode, preferably in two operating modes.

It is furthermore proposed that the switchover element be arranged, at least partially, on an upper side of the hammer drill. This advantageously allows optimal operation of the hand-held power tool by both left-handed and right-handed users. An "upper side of the hammer drill" in this context is to be understood to mean, in particular, a region located above a plane that is coaxial with a work axis of the hammer drill, and the plane being oriented in such a manner that a maximally large part of a handle of the hammer drill extends below the plane, and the region of the hammer drill forming the upper side extends above the plane.

It is furthermore proposed that the switchover element be mounted so as to be rotatable about a switchover axis of the switchover element. In particular, the switchover axis is coaxial with or parallel to a work axis of the hand-held power tool. Alternatively, other arrangements of the switchover axis are also conceivable, for example a crossing arrangement of the switchover axis relative to the work axis, or a substantially perpendicular arrangement of the switchover axis in relation to the work axis. The switchover axis and the work axis in this case may intersect or be arranged at an angle to each other.

It is additionally proposed that the switchover element be arranged outside of and/or at a distance from a transmission space. A "transmission space" in this case is to be understood to mean, in particular, a region of the hand-held power tool, or of the hammer drill, in which a transmission unit is accommodated. The transmission space is arranged, in particular, between a drive unit and a tool receiver. Preferably, the transmission space is sealed off from other interior space of the housing of the hand-held power tool, in such a manner that a lubricant contained in the transmission space cannot escape from it.

It is furthermore proposed that the switchover element be mechanically coupled to the operating-mode switchover unit. In the context of this application, that two components, or assemblies, are mechanically coupled to each other is to be understood to mean, in particular, that the components, or the assemblies, are connected to each other in such a manner that a movement of the one component causes a movement of the other component. The components, or the assemblies, in this case may be connected to each other in a force-fitting and/or form-fitting or materially bonded manner.

It is furthermore proposed that the switchover element have a switching device, wherein the switching device is designed to actuate a switching element of the operating-mode switchover unit. The switching device may be realized, for example, as a single piece or as a single part with the switchover element. The actuation of the switching element of the operating-mode switchover unit may be effected, in particular, in that a movement space of the switching element can be set by the switching device. Alternatively or additionally, it is conceivable for the switching device to apply a force to the switching element, in such a manner that the switching element is moved from a switching position into another position.

It is additionally proposed that the switchover element be mechanically coupled to the rotational-direction switchover unit. In particular, the switchover element has a further switching device, wherein the further switching device is designed to actuate a switching element of the rotational-direction switchover unit. The further switching device may be realized, for example, as a single piece or as a single part with the switchover element. The further switching device is realized, in particular, as a guide gate.

Both the switching element of the operating-mode switchover unit and the switching element of the rotational-direction switchover unit may be realized in a linearly movable and/or rotatably mounted manner. Alternatively, it is conceivable for the switchover element to be electronically coupled to the operating-mode switchover unit and/or to the rotational-direction switchover unit. An electronic coupling in this context is to be understood to mean, in particular, that a position of the switchover element is provided to a set of electronics of the hand-held power tool, and the actuation of the operating-mode switchover unit and/or of the rotational-direction switchover unit is effected via the set of electronics. For example, the actuation of the rotational-direction switchover unit may be effected directly via the set of electronics, by means of controlling of an electronic motor. An actuation of the operating-mode switchover unit via the set of electronics may be effected, for example, with the aid of an electrically controllable actuator.

It is furthermore proposed that the switching element of the operating-mode switchover unit be arranged in the transmission space, in particular be arranged in a linearly movable manner in a flange of the transmission space. It is additionally proposed that the switching element be connected to a sealing means, wherein the sealing means is realized, in particular, as a sealing ring and is arranged in a receiver. In this way it can be ensured, advantageously, that no lubricant can escape from the transmission space.

It is furthermore proposed that the switchover element, the first switching device and the second switching device be realized as a single piece.

It is furthermore proposed that the switchover device have a safeguard element, wherein the movement of the safeguard element is coupled to the movement of the switchover element, and the safeguard element is realized in such a manner that the actuation of the switchover element is at least partially restricted during operation of the hand-held power tool. In particular, the actuation of the switchover element during operation is restricted in such a manner that the switchover element cannot be switched into a further switching position. Advantageously, protection against unintentional operation of the hand-held power tool during operation can thus be realized. The safeguard element may be realized as a single piece or as a single part with the switching element.

The disclosure furthermore relates to a hammer drill having a switchover device, wherein the switchover device has a manually actuatable switchover element, having a housing, in which an electric motor and a transmission unit are arranged, wherein a rotational drive motion of the electric motor can be transmitted to a motor shaft, wherein the motor shaft is connected to an intermediate shaft for the purpose of transmitting torque, wherein the intermediate shaft is connected to an output shaft and a percussion-mechanism unit for the purpose of transmitting torque. It is proposed that the switchover element be designed to actuate an operating-mode switchover unit and a rotational-direction switchover unit.

It is furthermore proposed that the hammer drill have at least three modes, which can be switched via the switchover element, wherein the first mode is a hammer-drilling mode, the second mode is a drilling or screwdriving mode in clockwise rotation, and the third mode is a drilling or screwdriving mode in anticlockwise rotation. It is additionally proposed that, upon changing of the mode, either the rotational-direction switchover unit or the operating-mode switchover unit is switchable.

Alternatively, the disclosure relates to a hammer drill having a housing in which an electric motor and a transmission unit are arranged, wherein a rotational drive motion of the electric motor can be transmitted to a motor shaft, wherein the motor shaft is connected to an intermediate shaft for the purpose of transmitting torque, wherein the intermediate shaft is connected to an output shaft and to a wobble percussion-mechanism unit for the purpose of transmitting torque, wherein the intermediate shaft is mounted in a flange. It is proposed that the flange have a first radial bearing point and a second radial bearing point.

The first and the second radial bearing point are designed, in particular, to radially support the intermediate shaft. In particular, one radial bearing point, preferably the first radial bearing point, is realized as a journal bearing. A journal bearing in this case is to be understood to mean, in particular, a cylindrical extension of the intermediate shaft that is mounted in the flange of the hand-held power tool. The flange is designed, in particular, to lead through the motor shaft and/or the intermediate shaft. The flange is preferably realized as a single piece or as a single part. The transmission unit has at least one transmission, the transmission being designed, in particular, to transmit a torque, energy and/or a motion. The transmission may be realized, for example, as a gear transmission, as a spur gearing, as a planetary gearing, etc. In particular, the transmission unit has at least one first and one second transmission.

It is furthermore proposed that the intermediate shaft have a first pinion element and a second pinion element, wherein the first radial bearing joint is arranged in front of the first pinion element, and the second radial bearing point is arranged in front of the second pinion element. This makes it possible, advantageously, to realize a particularly compactly structured transmission. In particular, at least one of the radial bearing points, preferably the second radial bearing point, is arranged between the first and the second transmission. It is additionally proposed that the second bearing point be realized as a wing bearing. This advantageously allows easy assembly. A wing-bearing element is to be understood to mean, in particular, a radial plain-bearing element that, on its inside, has a receiver for a shaft and, on its outside, has at least one form-fit element for connecting the wing-bearing element to a housing, a transmission housing, a flange, or the like.

Alternatively, the disclosure relates to a hand-held power tool having a housing in which a drive unit and a transmission unit are accommodated, having a tool receiver for receiving an insert tool, wherein the housing is realized as an outer housing and has at least two housing parts, having a cooling unit for generating an air flow, wherein the airflow can be guided into the housing via at least one air opening. It is proposed that there be a housing gap arranged between the housing parts, wherein the housing gap forms an external air conveying channel that leads into the air opening. Advantageously, the arrangement of the air openings in the housing gap is such that the housing is only slightly weakened by the air openings. In addition, owing to the external conveying channels, it can be ensured that air can be drawn in laterally even if the air opening is covered above.

The housing parts can each be connected to at least one further housing part, wherein the connection is effected, in particular, via a force-fitting and/or form-fitting connection. The housing parts form, at least partially, an outer surface of the housing. The housing parts may be realized, for example, as housing half-shell parts, as a front shell part, as a top shell part, etc.

It is furthermore proposed that the air opening be arranged in a recess of the housing gap. Advantageously, owing to the external conveying channels, it can be ensured that air can be drawn in laterally even if the air opening is covered above. In particular, the air opening is arranged between two mutually spaced external air conveying channels.

It is furthermore proposed that the air opening be formed by one of the housing parts. Alternatively, it is proposed that the air opening be formed by both housing parts. It is additionally proposed that the air opening be formed by a third housing part. The air opening may be formed, in particular, by one or all housing parts forming the housing gap. It is also conceivable, however, for the air opening to be formed by one or more housing parts that are arranged beneath the housing gap.

It is furthermore proposed that the air opening be of an open or shielded design. An open design of the air opening advantageously enables particularly efficient cooling to be achieved. A shielded, or covered, design of the air opening can prevent, for example, larger stone particles having high kinetic energy from entering the housing directly without being deflected.

It is furthermore proposed that a length of the at least one air opening be less than 75% of a length of the housing gap, in particular less than 50% of the length of the housing gap, preferably less than 30% of the length of the housing gap.

It is additionally proposed that the hand-held power tool have a set of electronics, wherein the hand-held power tool has at least one air opening in the region of the set of electronics and/or in the region of the drive unit. Advantageously, effective cooling of the set of electronics can be achieved in this way. The set of electronics may be, for example, a printed circuit board, a computing unit, a memory unit, an electrical switch, or the like. The set of electronics is designed, in particular, to control at least one function by open-loop and/or closed-loop control.

It is furthermore proposed that the hand-held power tool have an integrated power supply, which comprises at least one battery cell, wherein at least one air opening is arranged in the region of an end of the at least one battery cell. Advantageously, efficient cooling of the power supply can be achieved in this way. An "integrated" power supply in this context is to be understood to mean, in particular, a power supply accommodated substantially entirely in the housing of the hand-held power tool. The integrated power supply is realized in a non-detachable manner with the hand-held power tool, in particular with the housing of the hand-held power tool.

It is furthermore proposed that at least one first air opening be assigned to a first internal conveying region, and at least one second air opening be assigned to a second internal conveying region, wherein the first internal conveying region is realized in such a manner that it guides the air flow past at least one battery cell, and the second internal conveying region is realized in such a manner that it guides the air flow past at least one set of electronics and/or a transmission. Advantageously, efficient cooling can be achieved in this way. In particular, the internal conveying regions are arranged entirely within the housing of the hand-held power tool. Preferably, the internal conveying regions are at least partially separated, preferably completely separated, from one another.

In particular, the first and second internal conveying channels merge in the region of the drive unit, preferably in the region of a fan of the drive unit. Advantageously, effective cooling of the drive unit, in particular of the electric motor, can be achieved in this way.

It is additionally proposed that at least one third air opening be assigned to a third internal conveying region, wherein the third internal conveying region is realized in such a manner that it guides the air flow past the transmission. Advantageously, effective cooling of the transmission can be achieve in this way.

Alternatively, the disclosure relates to a hand-held power tool having a housing in which a drive unit and a transmission unit are arranged, having a tool receiver for receiving an insert tool, having an integrated power supply unit, which has at least one battery cell. It is proposed that the hand-held power tool have a cell holder, wherein the cell holder has at least one receiving region for the at least one battery cell, and wherein the cell holder has at least one fastening element for fastening the cell holder in the housing of the hand-held power tool. In this way, advantageously, the fitting of the battery cells in the housing of the hand-held power tool can be improved.

The cell holder is realized, in particular, in such a manner that the battery cells are not completely enclosed in the cell holder. Preferably, the cell holder has a receiving region for each battery cell. The fastening elements are designed, in particular, to connect the cell holder to the housing of the hand-held power tool in a force-fitting and/or form-fitting manner. The cell holder may be realized as a single piece or as a single part.

It is furthermore proposed that the cell holder be realized as a single part or as a single piece, in particular as an assembly module. In this way, advantageously, assembly can be simplified. In particular, the cell holder realized as an assembly module is accommodated in the housing of the hand-held power tool so as to be non-detachable without use of tools.

It is furthermore proposed that the fastening element of the cell holder connect at least two housing parts of the housing of the hand-held power tool to each other. In this way, advantageously, a particularly compact structure of the hand-held power tool can be achieved.

Alternatively, the disclosure relates to a hand-held power tool, in particular a hammer drill, having a housing in which a drive unit and a transmission unit are accommodated, having a tool receiver for receiving an insert tool, wherein the tool receiver has a receiving sleeve that is rotatable and/or linearly movable for the purpose of fastening or releasing the insert tool, having an illumination unit for illuminating a work location, wherein the lighting unit has at least one lighting element. It is proposed that the receiving sleeve have at least one light-conducting channel, which is realized in such a manner that the light emitted by the at least one lighting element is guided outward, in particular laterally outward. In this way, advantageously, optimal illumination of the work location can be achieved.

The receiving sleeve is assigned, in particular, to a drill chuck or jaw chuck. In particular, the receiving sleeve is arranged in such a manner that the receiving sleeve can be gripped by a user for the purpose of actuation.

It is furthermore proposed that the transmission unit be accommodated in a transmission housing, wherein the transmission housing is enclosed at least partially, in particular completely, by the housing.

It is furthermore proposed that the at least one lighting element be arranged on a carrier element, in particular a printed circuit board of a set of electronics, wherein the at least one lighting element, in particular the printed circuit board, is connected to a further set of electronics of the hand-held power tool. In this way, advantageously, optimal control of the illumination unit can be achieved. In particular, the printed circuit board is realized in the shape of a ring.

It is additionally proposed that the illumination unit have a first light guide element, wherein the first light guide element bears at least partially against the carrier element and/or against the lighting element. The first light guide element is preferably composed of a transparent material. A "transparent" material in this case is to be understood to mean, in particular, a light-transmitting material. Preferably, the first light guide element is at least partially convex, more preferably the light guide element is convex on the side that faces away from the at least one lighting element.

In particular, the carrier element is fixed, via the first light guide element, to the housing or to the transmission housing of the hand-held power tool. This measure advantageously enables the lighting elements to be fixed in a structurally simple manner.

It is furthermore proposed that the illumination have a second light guide element, which is arranged in the light-conducting channel of the receiving sleeve. The second light guide element is preferably realized in the shape of a ring. In particular, the light guide element is connected in a force-fitting and/or form-fitting manner to the receiving sleeve. Preferably, the first light guide element is realized in such a manner that light emitted by the at least one lighting element is bundled, or focused, by the first light guide element in the direction of the second light guide element.

It is furthermore proposed that the second light guide element and the receiving sleeve be realized as a single part or as a single piece. For example, it is conceivable for the receiving sleeve to be made of a transparent material, or for the second light guide element and the receiving sleeve to be connected to each other in a materially bonded manner.

Alternatively, the disclosure relates to a hand-held power tool, in particular a hammer drill, having a housing in which a drive unit and a transmission unit are accommodated, having a tool receiver for receiving an insert tool, wherein the tool receiver has a receiving sleeve that is rotatable and/or linearly movable for the purpose of fastening or releasing the insert tool, having an illumination unit for illuminating a work location, wherein the lighting unit has at least one lighting element. It is proposed that the illumination unit has a light guide element, wherein the light guide element is fixedly connected to the receiving sleeve in such a manner that the light guide element is movable relative to the lighting element. In this way, advantageously, the illumination of the work location can be improved.

BRIEF DESCRIPTION OF THE DRAWINGS

Further advantages are given by the following description of the drawings. The drawings, the description and the claims contain numerous features in combination. Persons skilled in the art will expediently also consider the features individually and combine them to form useful further combinations. References of features of different embodiments of the disclosure that substantially correspond to each other are denoted by the same number and by a letter identifying the embodiment.

There are shown.

DETAILED DESCRIPTION

Figure 1A:
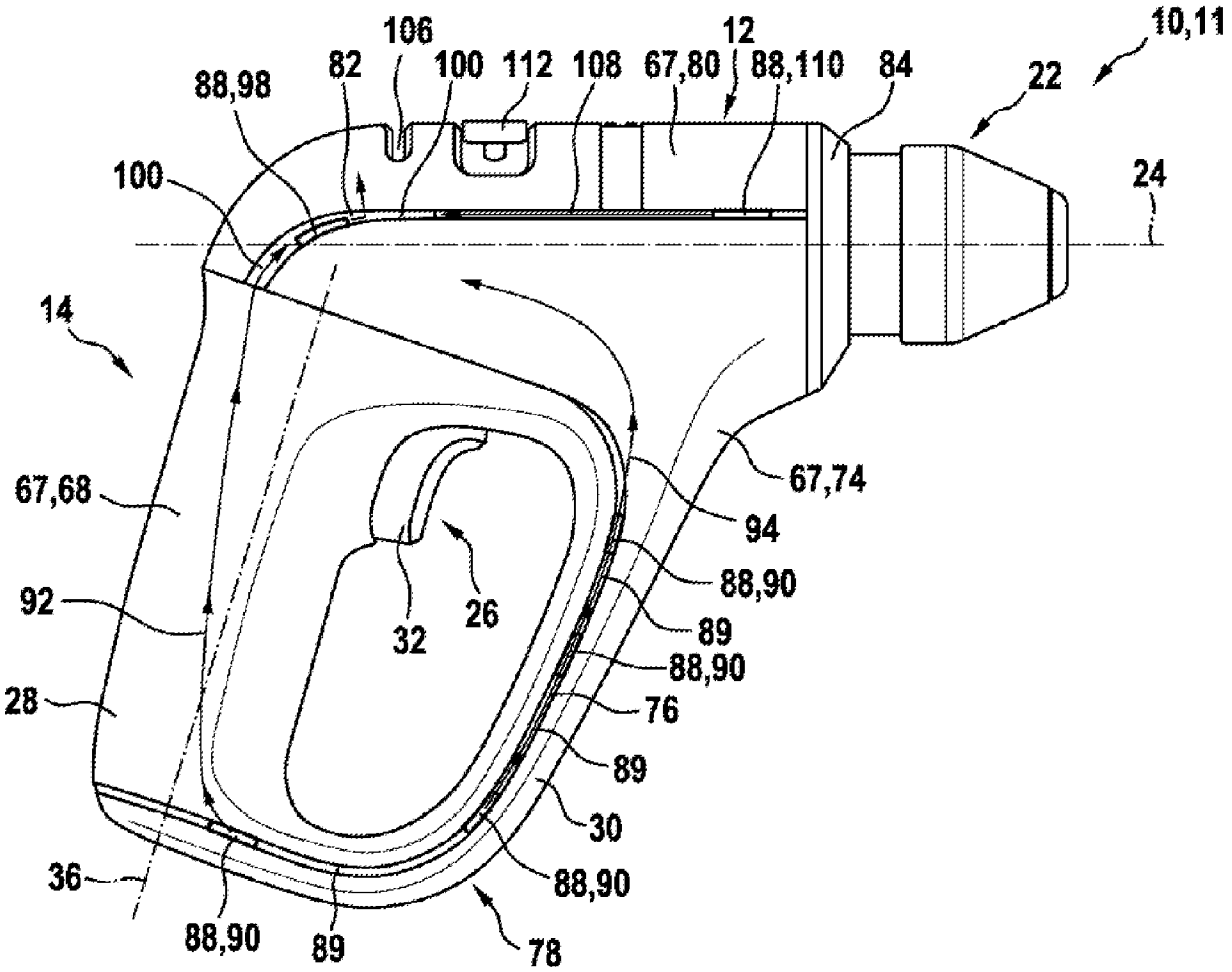
FIG. 1*a* a side view of a hand-held power tool according to the disclosure.
Figure 1B:
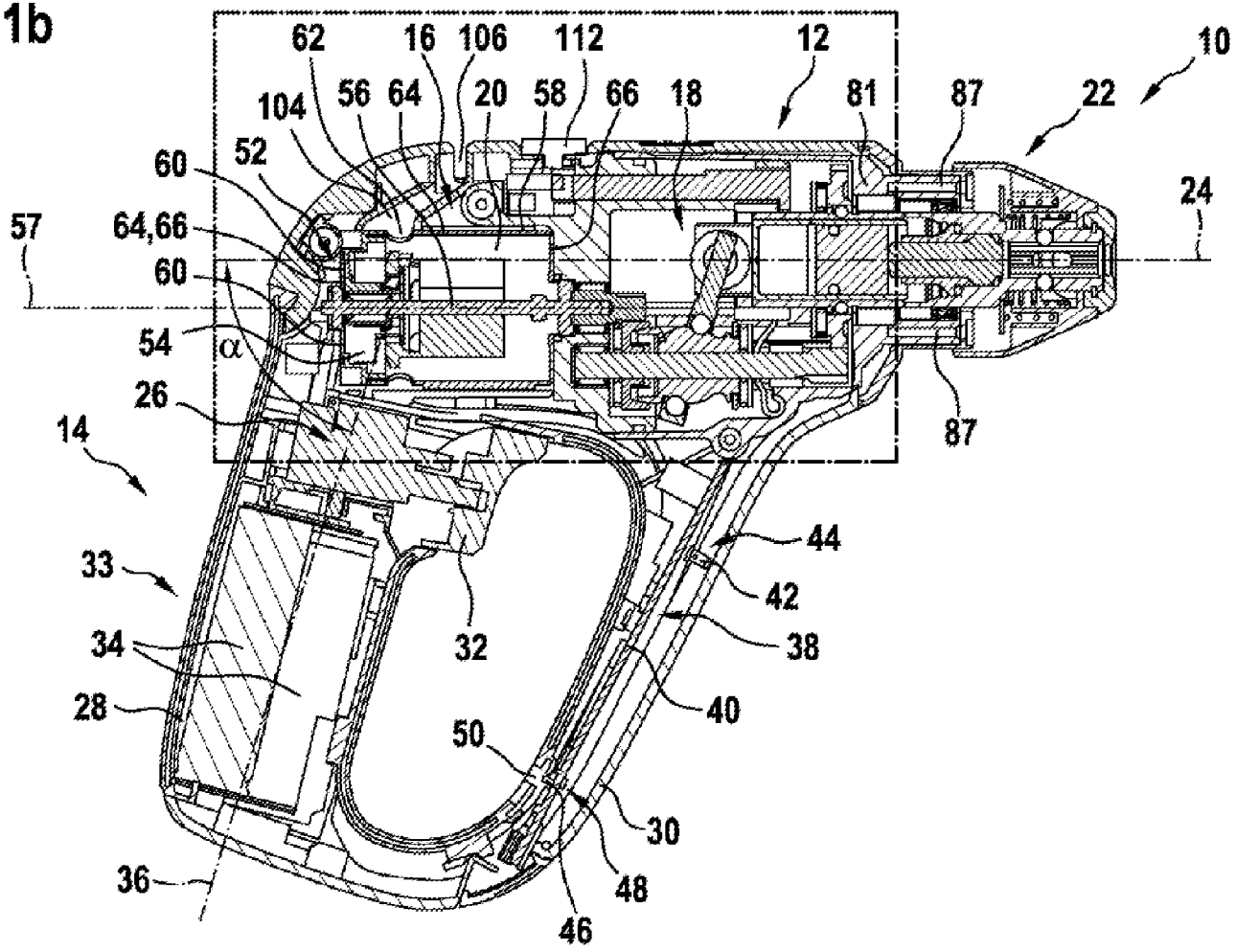
FIG. 1*b* a longitudinal section of the hand-held power tool according to FIG. 1*a;*

FIG. 1*a* shows a side view and FIG. 1*b* shows a longitudinal section of a hand-held power tool 10 according to the disclosure, which is realized, for example, as a hammer drill 11. The hand-held power tool 10 has a housing 12, which comprises an exemplarily U-shaped handle 14. The housing 12 of the hand-held power tool 10 is realized as an outer housing. There is a drive unit 16 and a transmission unit 18 realized in the housing 12 of the hand-held power tool 10. The drive unit 16 has an electric motor 20, which is realized, for example, as an EC motor. Alternatively, however, other motor types are also conceivable. The transmission unit 18 is designed to transmit a drive motion of the drive unit 16 to a tool receiver 22. An insert tool, not represented, for example a drill bit, a masonry drill bit or a chisel, can be fastened in the tool receiver 22. During operation, the insert tool can be driven in rotation about, and/or in a linearly oscillating, or percussive, manner along a work axis 24.

The hand-held power tool 10 has an operating switch 26, which is arranged on the handle 14. The operating switch 26 is realized, in particular, as a throttle switch. The handle 14 has a first leg 28 and a second leg 30, which are connected to each other. The first leg 28 has a greater distance from the tool receiver 22 than has the second leg 30. The operating switch 26 is arranged, in particular, on the first leg 28 of the handle 14. The operating switch 26 has an actuating element 32, via which the hand-held power tool 10 can be switched on and off. The actuating element 32 of the operating switch 26 is mounted, for example, so as to be movable linearly.

The hand-held power tool 10 is realized, for example, as a battery-operated hand-held power tool. The hand-held power tool 10 has an exemplarily integrated power supply 33. The power supply 33 comprises, for example, three battery cells 34. The battery cells are realized, for example, as Li-ion battery cells. In particular, the battery cells 34 are fastened in a non-detachable manner in the housing 12 of the hand-held power tool 10. The hand-held power tool 10 has a charging interface, not represented, via which the battery cells 34 integrated in the housing 12 can be charged. The charging interface may be realized, for example, as a USB socket or other type of charging socket. It is also conceivable for the charging interface to be realized in such a manner that the battery cells 34 integrated in the housing 12 can be charged inductively. The battery cells 34 are arranged adjacently to each other, in particular bearing against each other, in the handle 14, preferably in the first leg 28 of the handle 14. The battery cells 34 are arranged, in particular, parallel to a handle axis 36 along which the handle 14, or the first leg 28 of the handle 14, extends. In particular, the handle 14 is designed to be gripped around the handle axis 36. The handle axis 36 intersects the work axis 24. In particular, an angle a between the handle axis 36 and the work axis 24 is in a range of between 60° and 90°, preferably in a range of between 70° and 80°. For example, the angle a between the handle axis 36 and the work axis 24 is substantially 75°.

The battery cells 34 are arranged beneath the operating switch 26. Preferably, the battery cells 34 are arranged directly beneath the operating switch 26, in order to realize a hand-held power tool 10 that is as compact as possible. Alternatively, it would also be conceivable for the power supply 33 to have a battery interface for a hand-held power tool battery pack, the hand-held power tool battery pack having a battery-pack housing in which the battery cells are arranged, and that is designed such that it can be detachably connected to the housing of the hand-held power tool.

The hand-held power tool 10 further more has a set of electronics 38. The set of electronics 38 is designed, in particular, to control the hand-held power tool 10 by closed-loop or open-loop control. The set of electronics 38 comprises a printed circuit board 40, which is arranged, for example, in the handle 14, or in the second leg of the handle 14. In particular, the length of the printed circuit board 40 corresponds substantially to the length of the second leg 30 of the handle 14. There is at least one computing unit, for example a microprocessor, arranged on the printed circuit board 40. Also arranged on the printed circuit board 40 is a lighting element 42 of an illumination unit 44. The illumination unit 44 is designed to illuminate a work location. The lighting element 42 is realized, for example, as an LED. The lighting element 42 is arranged on the side of the printed circuit board 40 that faces toward the tool receiver 22. The set of electronics 38 is electrically connected to the operating switch 25, such that an actuation of the operating switch 26 can be sensed by the set of electronics 38. In particular, the set of electronics 38 is designed to activate the illumination unit 44 upon actuation of the operating switch 26.

Arranged on the side of the printed circuit board 40 that faces away from the tool receiver 22 is a further lighting element 46, which is assigned to a charge-state indicator 48. The power supply 33, in particular the battery cells 34, is/are electrically connected to the set of electronics 38 in such a manner that the charge state of the power supply 33, or of the battery cells 34, can be ascertained via the set of electronics 38. In particular, the set of electronics 38 is designed to indicate the charge state of the power supply 33, or of the battery cells 34, via the lighting element 46 of the charge-state indicator 48. The light emitted by the lighting element 46 emerges from the housing 12, through a housing opening 50 of the housing 12, on a side that faces away from the tool receiver 22. With this arrangement it can advantageously be ensured that the charge-state indicator 48 is in the user's field of vision during operation of the hand-held power tool 10. Alternatively, it would also be conceivable for the housing opening 50 to be arranged on the side.

The hand-held power tool 10 furthermore has a cooling unit 52, which is designed to generate an air flow, or cooling air flow. The cooling unit 52 comprises a fan element 54. The fan element 54 is realized, for example, as a radial ventilator. The fan element 54 is arranged on a motor shaft 56 of the electric motor 20. A motor axis 57 extends along the motor shaft 56. In particular, the fan element 54 is connected to the motor shaft 56 in a rotationally fixed manner. The electric motor 20 has a motor housing 58 in which the fan element 54 is arranged. The motor housing 58 has air inlets 60 via which the air flow enters the motor housing 58, and has air outlets 62 via which the air flow exits the motor housing 58. The motor housing 58 is substantially cylindrical, and has a circumferential wall 64 and two mutually parallel side walls 66. The side walls 66 are substantially perpendicular to the motor axis 57. The air inlets 60 are arranged, for example, in both side walls 66, such that a respective air flow is drawn in from both sides, through the fan element 54. Alternatively, it would also be conceivable for the air inlets 60 to be arranged only in one of the side walls 66. The air outlets 62 are arranged in the circumferential wall 64, in particular in the region of the fan element 54, preferably radially outside the fan element 54. Thus, by means of the fan element 54, two opposing air flows are generated, which enter the motor housing 58 axially via the air inlets 60 and exit the motor housing 58 as a common air flow via the air outlets 62.

Figure 2:
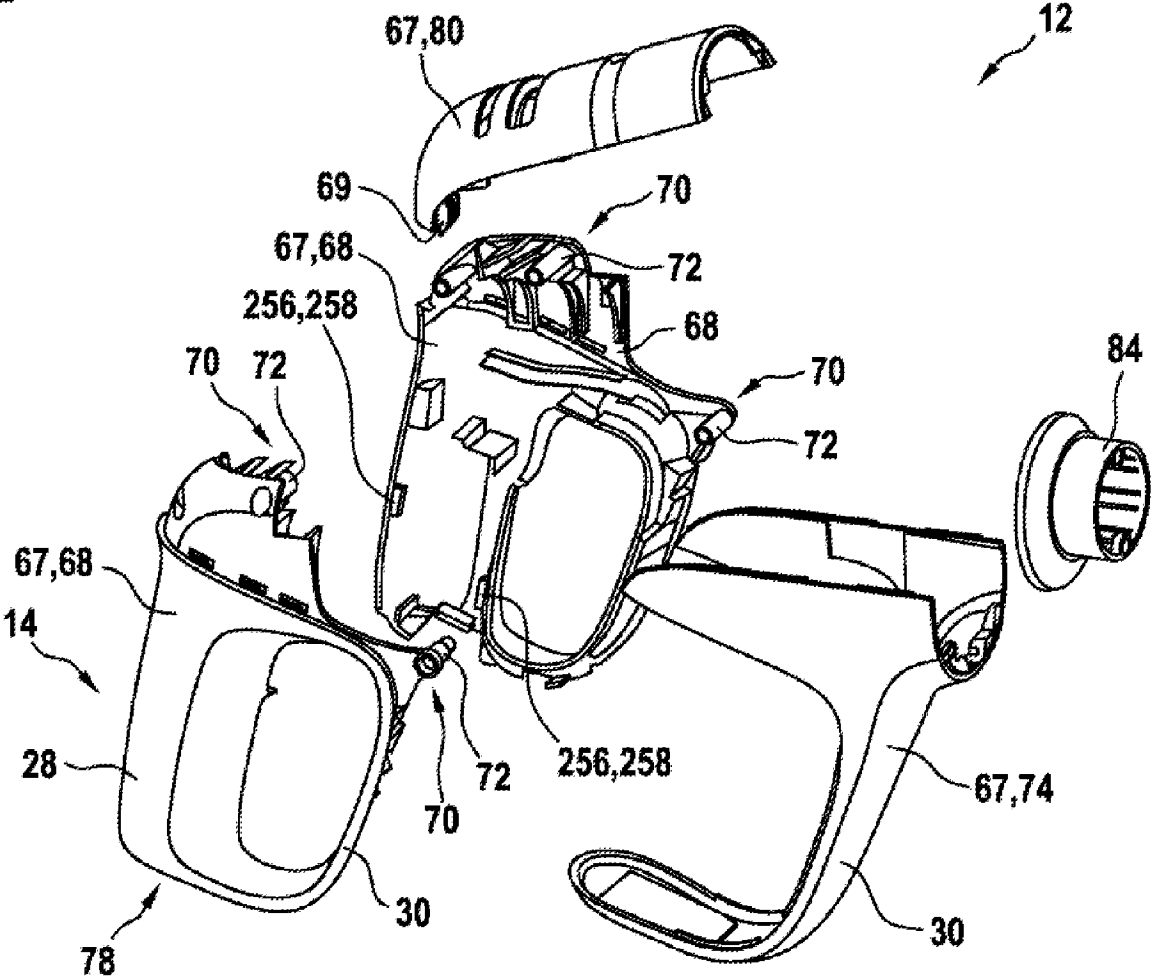
FIG. 2 an exploded view of a housing of the hand-held power tool according to FIG. 1*a;*

The following describes in greater detail how the air flow generated by the cooling unit 52 is routed through the housing 12 of the hand-held power tool 10. FIG. 2 shows an exploded view of the housing 12 of the hand-held power tool 10.

The housing 12 has two housing parts 67, realized as housing half-shell parts 68, which are connected to each other by means of screw connections 70. The screw connections 70 are effected by means of screw bosses 72 that are substantially perpendicular to the work axis 24. The housing half-shell parts 68 preferably partially form the handle 14 and they accommodate, at least partially, preferably completely, the battery cells 34, the operating switch 26 and the electric motor. In particular, the two housing half-shell parts 68 completely form the first leg 28 of the handle 14, and partially form the second leg 30 of the handle 14.

The two housing half-shell parts 68 can be connected to a housing part 67 realized as a front shell part 74. The front shell part 74 is designed, in particular, in such a manner that at least one screw boss 72 of the housing half-shell parts 68 is covered. "Covered" in this context is to be understood to mean, in particular, that, in the assembled state, the screw boss 72 or a screw fastened in the screw boss 72 is not visible from the outside. The two housing half-shell parts 68 and the front shell part 74 together form the two legs 30 of the handle 14.

The housing half-shell parts 68 and the front shell part 74 are shaped in such a manner that, in the connected state, a first housing gap 76 (see FIG. 1) is realized. The first housing gap 76 begins in a bottom region 78, in which the first leg 28 merges into the second leg 30. In the bottom region 78, the first housing gap 76 extends from the first leg 28 to the second leg 30 of the handle 14. In the region of the second leg 30, the housing gap 76 substantially follows the longitudinal extent of the second leg 30, and ends in the upper region of the second leg 30. In particular, the first housing gap 76 is arranged laterally. In the context of this application, a "lateral" arrangement is to be understood to mean, in particular, an arrangement on a side of the hand-held power tool 10 that is substantially parallel to the work axis 24 of the hand-held power tool 10 and parallel to the handle axis 36 of the handle 14.

In addition, the front shell part 74 partially encloses the transmission unit 18, and is open upwardly in the region of the transmission unit 18. The two housing half-shell parts 68 are connected to a housing part 67 that is realized as a top shell part 80. The top shell part 80 is engaged in the two housing half-shell parts 68, in particular, via a form-fit element 69. The top shell part 80 forms the upper side of the housing 12. The top shell part 80 and the front shell part 74 together enclose the transmission unit 18 substantially completely. The transmission unit 18 is additionally enclose by a transmission housing 81. The transmission housing 81 may be composed of a metallic material or of plastic, wherein the plastic preferably has a greater strength and/or resistivity than the material of the housing 12. In order to reduce the wear on the transmission unit 18 the transmission unit is provided with a lubricant. Owing to the transmission housing 81, it can be ensured that the lubricant does not escape from the transmission unit 18, or from the transmission space 200 spanned by the transmission housing 81.

The top shell part 80 and the front shell part 74 are shaped in such a manner that a second housing gap 82 (see FIG. 4) is realized between them. The second housing gap 82 has a curved form. The second housing gap 82 is arranged in a region of the housing 12 that surrounds the drive unit 16, in particular the electric motor 20. The second housing gap 82 extends, at least partially, substantially along the work axis 24 of the hand-held power tool 10. In particular, the hand-held power tool 10 has a respective first housing gap 76 and a second housing gap 82 on both sides.

The front shell part 74 and the top shell part 80 end at the same level on their side that faces toward the tool receiver 22, and form a receiver for a front ring 84. In the region of the receiver the front ring 84 bears against the front shell part 74 and the top shell part 80, and is screw connected to the transmission housing 81. For this purpose, the transmission housing 81 has screw bosses 87 (see FIG. 1*b*), which are substantially parallel to the work axis 24.

The first housing gap 76 is arranged on the outside of the housing 12. The first housing gap 76 is realized, in particular, as an external groove that is interrupted by air openings 88 via which the air can enter and exit the housing 12 of the hand-held power tool. The external grooves in this case form an external conveying channel 89 via which air, or the air flow, can enter the air openings 88 even if the air openings 88 are covered immediately above, for example by the user's hand.

The air openings 88 of the first housing gap 76 are realized, in particular, as air inlet openings 90, via which the air flow generated by the cooling unit 52 enters the housing 12 of the hand-held power tool 10. The air openings 88 of the first housing gap 76 are assigned to a first internal conveying region 92 and to a second internal conveying region 94. The internal conveying regions 92, 94 are designed to route the air flow, generated by the cooling unit 52, from the air inlet opening 90 to the cooling unit 52. The at least two internal conveying regions 92, 94 are preferably realized in such a manner that the air flows are routed to the cooling unit 52 at least partially, preferably completely, spaced apart from each other.

The first internal conveying region 92 is designed to cool the power supply 33. Furthermore, the first internal conveying region 92 is designed subsequently to cool the electric motor 20. The air inlet opening 90 assigned to the first internal conveying region 92 is arranged in the region of the battery cells 34, in particular in the bottom region 78 of the handle 14 beneath the battery cells 34. The first internal conveying region 92 has two opposing lateral air inlet openings 90. The internal conveying region 92 thus extends along the entire length of the battery cells 34, and past the operating switch 26 to the air inlets 60 of the motor housing 58, which are located on the side of the motor housing 58 that faces away from the tool receiver 22. The first internal conveying region 92 thus extends substantially completely through the first leg 28 of the handle 14.

The second internal conveying region 94 is designed to cool the set of electronics 38 and partially to cool the transmission unit 18. Furthermore, the second internal conveying region 94 is designed subsequently to cool the electric motor 20. The air inlet openings assigned to the second internal conveying region 94 are arranged in the region of the set of electronics 38, in particular in the region of the printed circuit board 40. The second internal conveying region 94 has six lateral air inlet openings 90, three air inlet openings 90 being arranged on each side of the housing 12. In the second internal conveying region 94, the air flow is guided substantially completely past the printed circuit board 40 and past the transmission 81, to the air inlets 60 of the motor housing 58, the air inlets 60 being arranged on a side of the motor housing 58 that faces toward the tool receiver 22. The second internal conveying region 94 thus extends substantially completely through the second leg 30 of the handle 14.

Arranged in the bottom region 78 of the handle 14 there is wiring between the power supply 33 and the set of electronics 38. The structural space in the bottom region 78 is preferably of such dimensions that the wiring substantially completely fills the structural space in the bottom region 78, such that the air flows in the bottom region 78 do not mix with each other.

Figure 3:
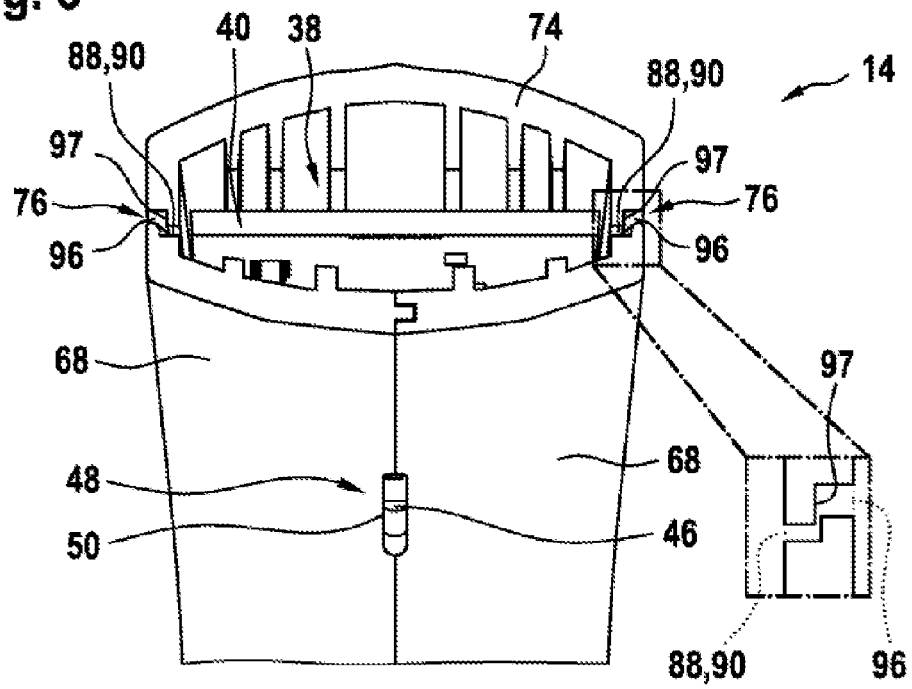
FIG. 3 a cross-section through a handle of the hand-held power tool according to FIG. 1*a;*

FIG. 3 shows a cross-section through two air openings 88, realized as air inlet openings 90, in the second leg 30 of the handle 14. As already described, the housing gap 76, in particular the air opening 88, is formed by two housing parts 67, namely, the front shell part 74 and one of the housing half-shell parts 68. The air openings 88 of the first housing gap 76 are of a shielded design, for example. "Shielded" in this context is to be understood to mean, in particular, that the air opening 88 via which the air flow enters the housing 12 is offset from a gap opening 96 via which an air flow enters the housing gap 76. In particular, the air flow is routed, not in a straight line, but at an angle in the housing gap 76. This is realized, for example, in that the edges of the front shell part 74 and of the housing half-shell part 86, which form the housing gap 76, are substantially L-shaped in the region of the air opening 88, and engage in each other at a distance from each other. This advantageously forms, in the housing gap 76 between the air opening 88 and the gap opening 96, a protective element 97 against which larger dust particles that enter the housing gap in a straight line and with high kinetic energy rebound and exit the housing gap 76 again through the gap opening 96, without entering the housing 12 of the hand-held power tool 10.

Figure 4:
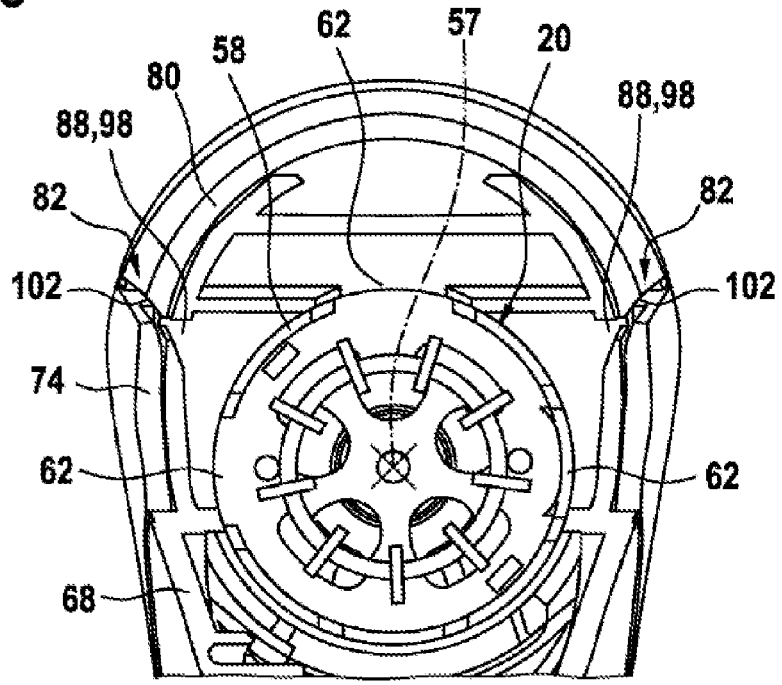
FIG. 4 a cross-section of the hand-held power tool in the region of a fan element.

FIG. 4 shows a cross-section through two air openings 88 of the second housing gap 82 that are realized as air outlet openings 98. The air outlet openings 98 are arranged in the region of the electric moor 20, in particular in the region of the air outlets 62 of the motor housing 58, in order to route the exhaust air of the cooling unit 52 out of the housing 12 of the hand-held power tool 10 preferably, the air outlet openings 98 of the second housing gap 82 are arranged radially outside the fan element 54. The air opening 88 of the second housing gap 82, realized as an air outlet opening 98, is arranged laterally. In particular, the housing 12 of the hand-held power tool 10 has two opposing lateral air outlet openings 98. The second housing gap 82 is formed by the front shell part 74, the top shell part 80 and the housing half-shell parts 68. The front shell part 74 and the top shell part 80 form an external wall of the second housing gap 82, and the housing half-shell parts 68 form an internal wall of the second housing gap 82.

The air opening 88 of the second housing gap 82 is arranged between two external conveying channels 100 (see FIG. 1*a*). The external conveying channels 100 are realized as external grooves. In particular, the external conveying channels 100 are delimited at the sides by the front shell part 74 and the top shell part 80, and a groove base is formed by the housing half-shell part 68, in particular by an outer wall surface of the housing half-shell part 68. The air outlet openings 98 of the second housing gap 82 are formed by the housing half-shell parts 68. The gap openings 102 of the second housing gap 82 are formed by the front shell part 74 and by the top shell part 80. The air opening 88 of the second housing gap 82 is open, such that the air flow can exit the housing 12 directly, or on a straight path. This is realized in that the air opening 88 and the gap opening 102 are substantially above one another.

The housing 12 of the hand-held power tool 10 additionally has an exhaust-air channel 104, which routes the air flow between an air outlet 62 of the motor housing 58 and an exhaust-air opening 106 of the housing 12, which is arranged, for example, in the top shell part 80, directly outward. It can thereby be ensured, advantageously, that the exhaust air from the air outlet 62 is not sucked back in by the cooling unit 52.

Alternatively or optionally, it would also be conceivable for the hand-held power tool 10 to have a third internal conveying region 108, in which at least one lateral air opening 110, arranged in a housing gap, is arranged, the third conveying region 108 routing the air flow between the housing 12 and the transmission housing 81 for the purpose of cooling the transmission unit 18. It would be conceivable, for example, for the air opening 110 assigned to the third internal conveying region 108 also to be arranged in the second housing gap 82.

The hand-held power tool 10 realized as a hammer drill 11 has three operating modes, the first operating mode being a hammer-drilling mode, the second operating mode being a screwdriving and/or drilling mode in clockwise rotation, and the third operating mode being a screwdriving and/or drilling mode in anticlockwise rotation. The hand-held power tool 10 has a single operating element 112 (see FIG. 1), via which all operating modes of the hand-held power tool 10 can be switched. The operating element 112 is arranged on an upper side of the housing 12 of the hand-held power tool 10, in particular in a recess of the top shell part 80.

Figure 5:
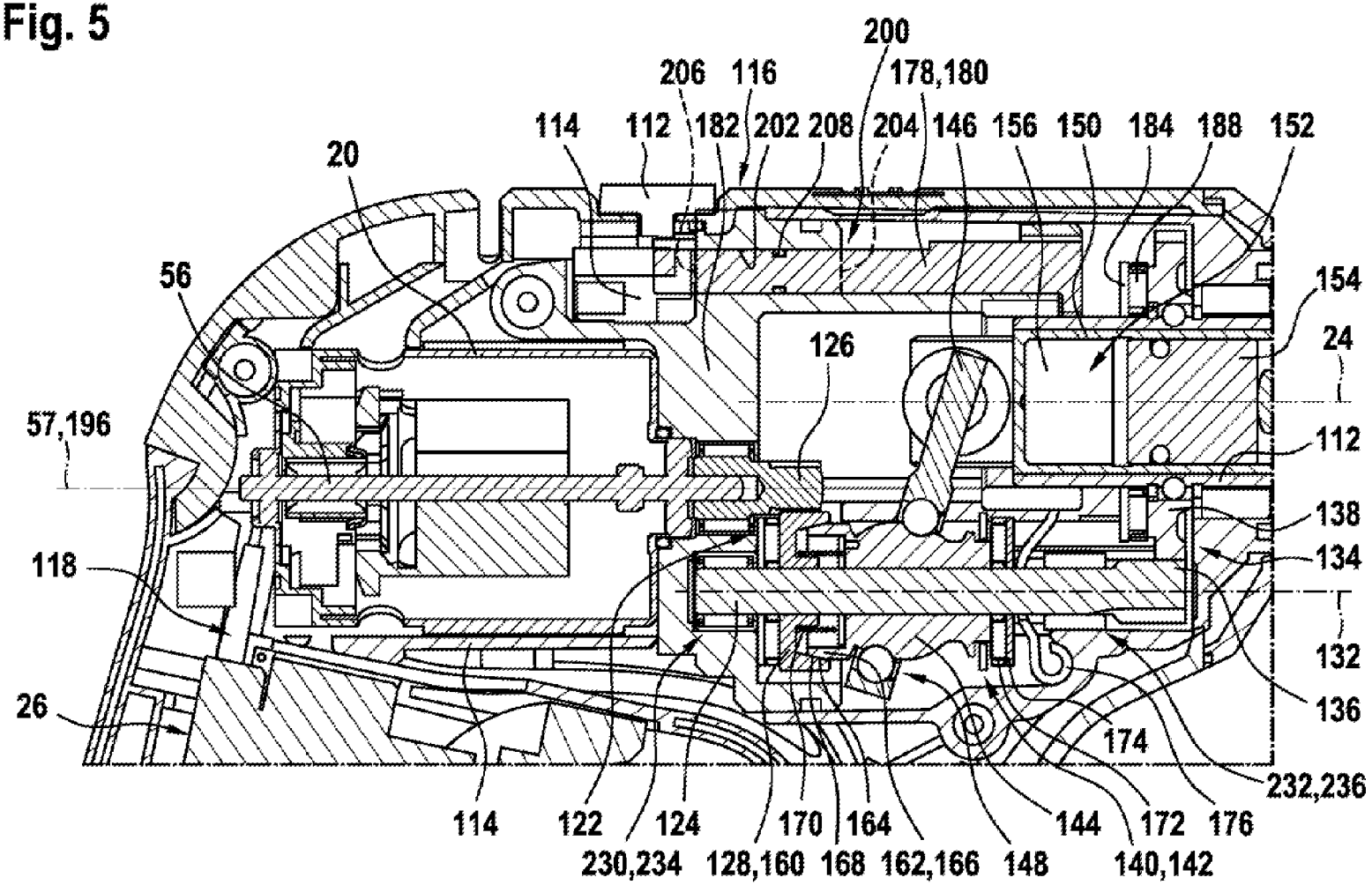
FIG. 5 an enlarge sub-region of the longitudinal section according to FIG. 1*b;*

FIG. 5 shows a detail of FIG. 1*b* in an enlarged representation. In FIG. 5 the hand-held power tool 10, or the transmission unit 18, is shown in a hammer-drilling mode.

The switchover between the operating modes is effected via a switchover device 113. The switchover device 113 is designed, in particular, to be mechanically actuatable. The switchover device 113 comprises a switchover element 114. The operating element 112 and the switchover element 114 are mechanically coupled to each other. In particular, the operating element 112 and the switchover element 114 are connected to each other in a force-fitting and/or form-fitting manner. Alternatively, it is also conceivable for the operating element 112 and the switchover element 114 to be realized as a single piece or as a single part with each other. The switchover element 114 is arranged completely within the housing 12 of the hand-held power tool 10.

The switchover device has an operating-mode switchover unit 116 and a rotational-direction switchover unit 118. The switchover element 114 is designed to actuate the operating-mode switchover unit 116 and the rotational-direction switchover unit 118. The operating-mode switchover unit 116 is designed to switch over an operating mode. The hand-held power tool 10, realized as a hammer drill 11, has two different operating modes, namely a drilling mode and a hammer-drilling mode.

In the drilling mode, a rotational drive motion of the electric motor is transmitted to an output shaft 120, which in turn can be connected to the insert tool. The transmission unit 18 has a first transmission 122. The first transmission 122 is realized, for example, as a spur gearing. Alternatively, a different type of transmission, for example a planetary gearing, would also be conceivable. The motor shaft 56 of the electric motor 20 is connected to an intermediate shaft 124 via the first transmission 122. The first transmission 122 has a first pinion element 126, which is connected in a rotationally fixed manner to the motor shaft 56. Furthermore, the first transmission 122 has a second pinion element 128, which is connected in a rotation fixed manner to the intermediate shaft 124. The first and the second pinion element 126, 128 engage in each other in such a manner that a torque can be transmitted from the motor shaft 56 to the intermediate shaft 124.

The intermediate shaft 124 is substantially parallel to the motor shaft 56 and to the output shaft 120. The intermediate shaft 124 is mounted so as to be rotatable about an intermediate-shaft axis 132. The intermediate-shaft axis 132 is parallel to the motor axis 57 and parallel to the work axis 24. The intermediate-shaft axis 132 has a greater distance from the work axis 24 than has the motor axis 57.

The transmission unit 18 has a second transmission 134. The second transmission 134 is designed to transmit torque from the intermediate shaft 124 to the output shaft 120. The second transmission 134 is realized, for example, as a spur gearing. Alternatively, a different type of transmission, for example a planetary gearing, would also be conceivable. The second transmission 134 has a first pinion element 136 that is realized, for example, as a single piece with the intermediate shaft 124. The second transmission 134 additionally has a second pinion element 138, which is connected in a rotationally fixed manner to the output shaft 120. The first pinion element 136 and the second pinion element 138 of the second transmission 134 engage in each other in such a manner that a torque can be transmitted from the intermediate shaft 124 to the output shaft 120.

The output shaft 120 is realized, for example, as a hammer tube. The hammer tube is assigned to a percussion-mechanism unit 140. The percussion-mechanism unit 140 comprises a pneumatic percussion mechanism. In particular, the percussion-mechanism unit 140 is realized as a wobble percussion-mechanism unit 142. The wobble percussion-mechanism unit 142 has a wobble bearing 144, which is mounted in a rotatable and axially movable manner on the intermediate shaft. The wobble bearing 144 is arranged, between the first transmission 122 and the second transmission 134, on the intermediate shaft 124. The wobble bearing 144 is connected to a wobble finger 146. In particular, the wobble finger 146 is connected to the wobble bearing 144 via a ball bearing 148. The wobble finger 146 is connected to a piston 150.

The piston 150 is arranged in a partially linearly movable manner in the output shaft 120, in particular in the hammer tube. On its side that faces toward the tool receiver 22 the piston 150 has a hollow cylindrical region 152, in which a striker 154 is accommodated in a linearly movable manner. The striker 154 is accommodated in the hollow cylindrical region in such a manner that an air compression space 156 is formed in the hollow cylindrical region 152. The air compression space 156 is arranged on the side of the striker 154 that faces away from the tool receiver 22.

In the drilling mode, the percussion-mechanism unit 140 is decoupled from the drive motion of the drive unit 16, or of the electric motor 20. No torque is transmitted, and the wobble finger 146 is at a standstill.

The percussion-mechanism unit 140 comprises a clutch 158, via which the percussion-mechanism unit 140 can be coupled to the drive unit 16. The clutch 158 is realized, in particular, as a so-called cone clutch. The clutch 158 comprises a first clutch element 160 and a second clutch element 162, which can be connected to each other. The first clutch element 160 is connected in a rotationally fixed manner to the intermediate shaft 124. In particular, the first clutch element 160 is realized as a single piece with the second pinion element 128 of the first transmission 122. The first clutch element 160 is realized, in particular, as a conical interior 164 of a hollow cylindrical region of the second pinion element 128. The second clutch element 162 is connected in a rotationally fixed manner to the wobble bearing 144. In particular, the second clutch element 162 is realized as a single piece with the wobble bearing 144. The second clutch element 162 is arranged on the side of the wobble bearing 144 that faces toward the first transmission 122. The second clutch element 162 is realized, for example, as a hollow cylindrical formation 166 on the wobble bearing 144, the formation 166 having a conical exterior 168.

In the hammer-drilling mode represented, the two clutch elements 160, 162 bear against each other in such a manner that a force fit is effected between the first and the second clutch element 106, 162, as a result of which a torque can be transmitted from the intermediate shaft 124 to the wobble bearing 144. In particular, the conical interior 164 of the first clutch element 160 bears against the conical exterior 168 of the second clutch element 162. The percussion-mechanism unit 140 is designed, by means of a wobble motion of the wobble finger 146, to convert a torque, acting upon the wobble bearing 144, into an axial motion of the piston 150. In the drilling mode, the two clutch elements 160, 162 are spaced apart from each other, preferably disengaged.

The wobble bearing 144 is mounted in an axially displaceable manner on the intermediate shaft 124. On the side of the wobble bearing 144 that faces toward the first transmission 122, a force emanating from a spring element 170 acts upon the wobble bearing. The spring element 170 is arranged between the first clutch element 160 and the second clutch element 162, and thus applies a force to the wobble bearing 144 in the direction of the second transmission 134. The spring element 170 is realized, for example, as an annular spring, in particular as a metallic annular spring. On the side of the wobble bearing 144 that faces toward the second transmission 134, the wobble bearing bears, via an axial bearing 172 and a washer 174, against a switching lever 176. The switching lever 176 is formed from a sheet metal. The switching lever 176 is coupled to the tool receiver 22. The tool receiver 22 is designed to be at least partially axially movable. In particular, the output shaft 120 is mounted so as to be axially movable. If the hand-held power tool 10, with the insert tool inserted, is pressed against a workpiece, for example a wall, a force acts via the insert tool upon the output shaft 120, displacing the output shaft 120, in the hammer-drilling mode, into the housing 12, or in a direction opposite to the workpiece.

The switching lever 176 is coupled to the output shaft 120 in such a manner that the switching lever 176 applies a force to the wobble bearing 144 in the direction of the first transmission 122 as soon as the insert tool is pressed against the wall, as a result of which the two clutch elements 160, 162 become connected to each other and the pneumatic percussion-mechanism unit 140 becomes activated.

Figure 6:
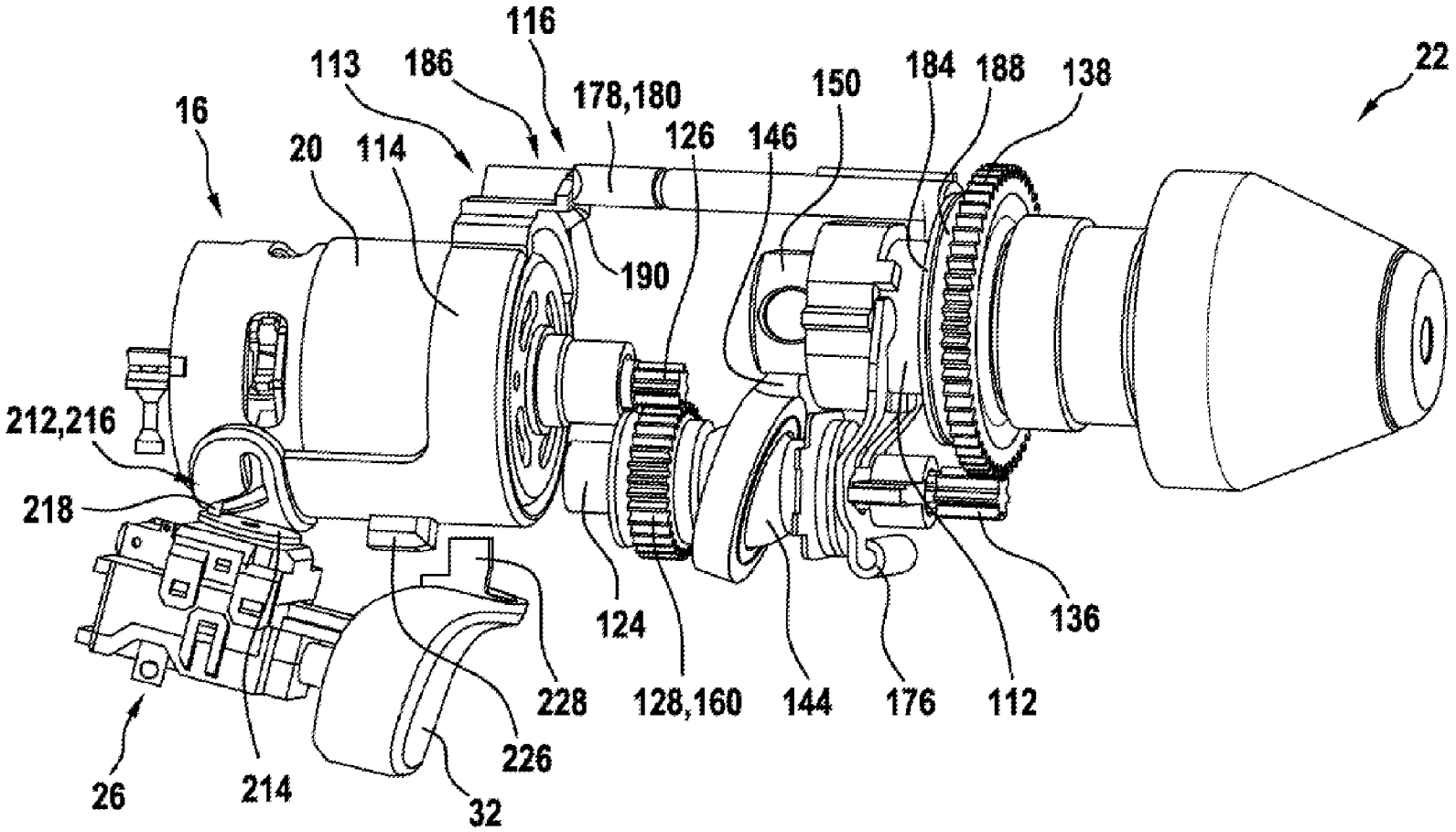
FIG. 6 a perspective view of a switchover device of the hand-held power tool.

FIG. 6 shows a perspective view of the switchover device 113 and the transmission unit 18 that can be switched by the switchover element 114, and of the operating switch 26 that can be switched by the switchover element 114. In FIG. 6, the hand-held power tool 10 is switched via the switchover element 114 in such a manner that the insert tool can be driven in a drilling mode in clockwise rotation.

Figure 7A:
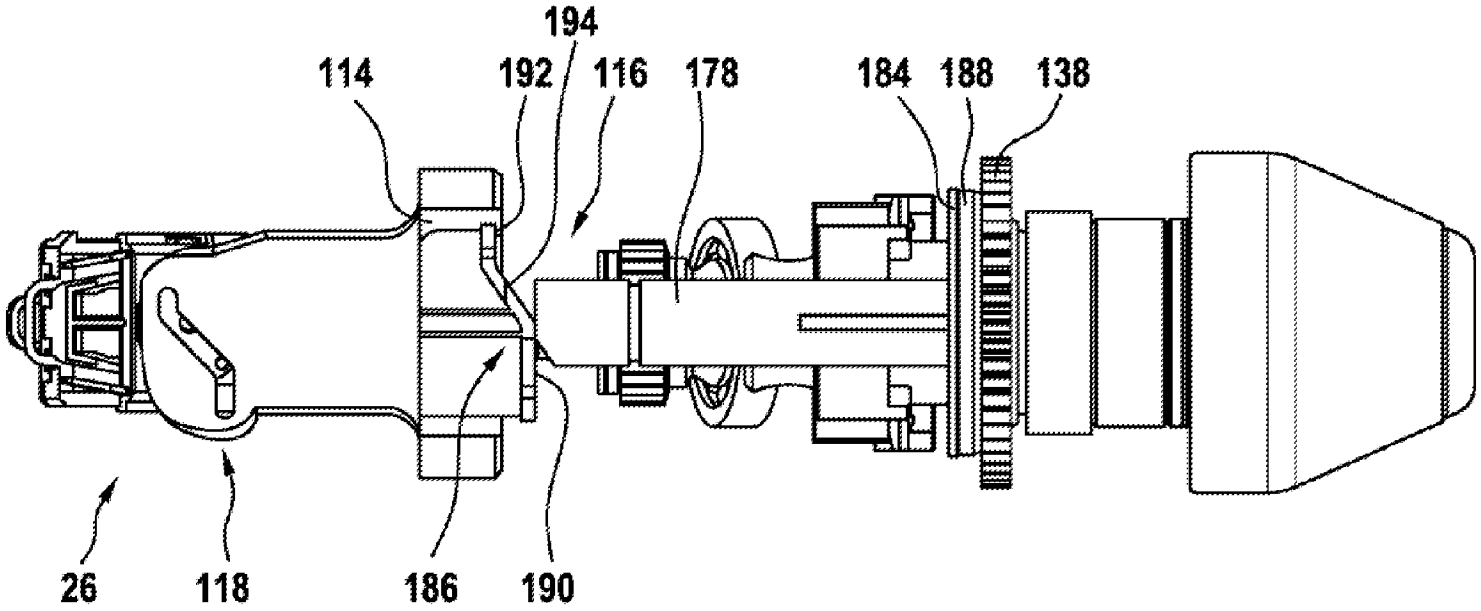
FIG. 7*a* a top view of the switchover device in a drilling mode in clockwise rotation.
Figure 7B:
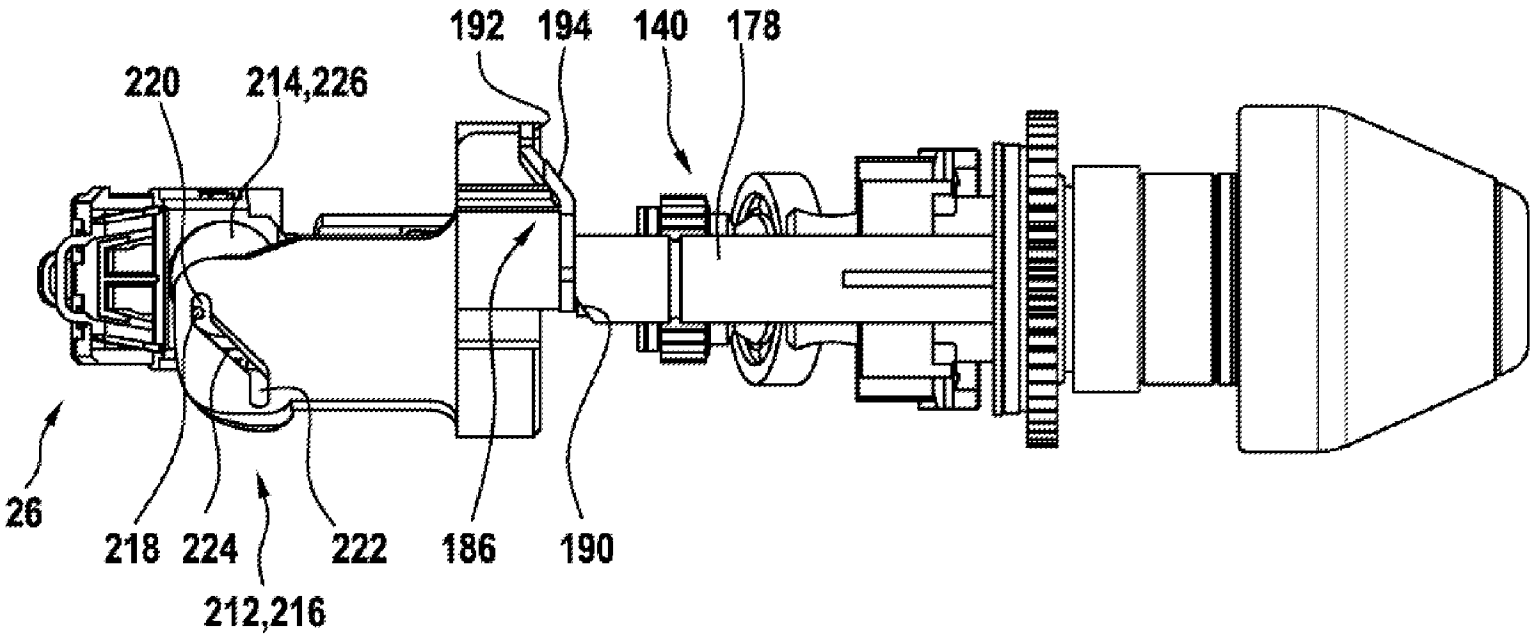
FIG. 7*b* a top view of the switchover device in a drilling mode in anticlockwise rotation.
Figure 7C:
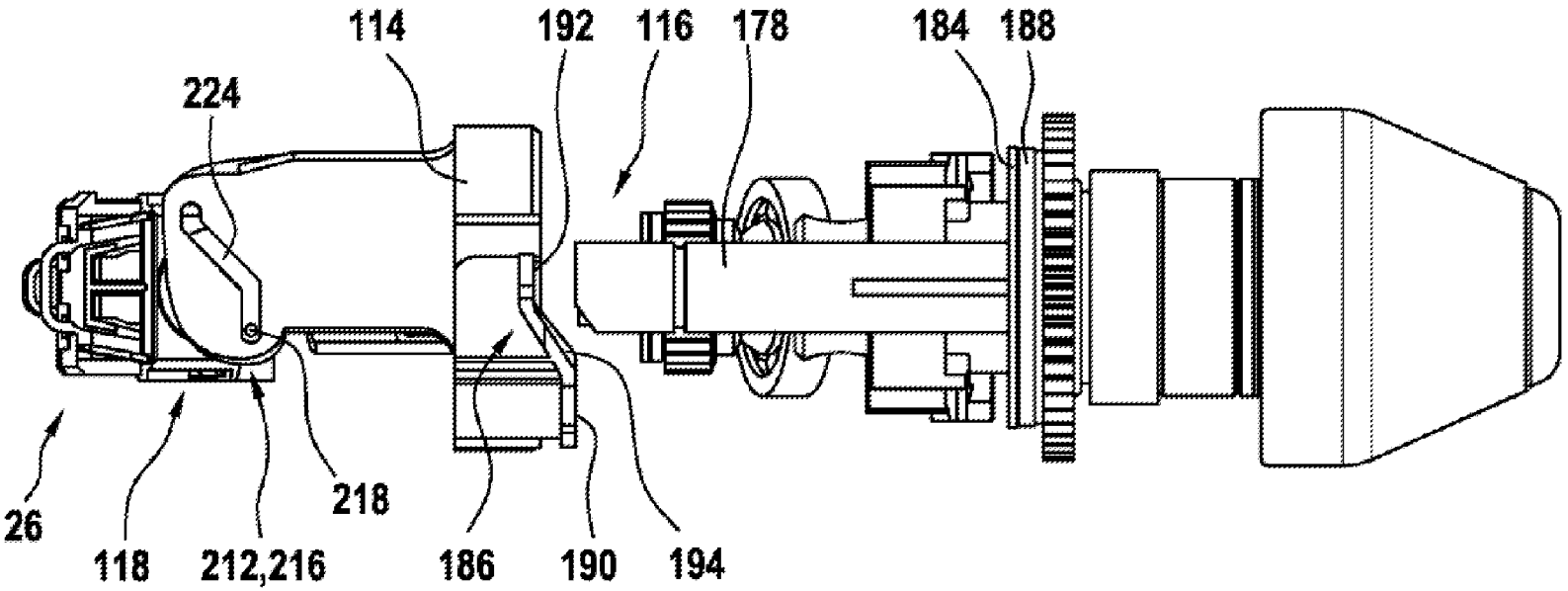
FIG. 7*c* a top view of the switchover device in a hammer-drilling mode in clockwise rotation.

FIGS. 7*a*-7*c* each show a top view of the position of the switchover element 114, in three different switching positions. FIG. 7*a* shows the hand-held power tool 10 in a drilling mode in clockwise rotation, corresponding to FIG. 6. FIG. 7*b* shows the hand-held power tool in a drilling mode in anticlockwise rotation, and FIG. 7*c* shows the hand-held power tool 10 in a hammer-drilling mode in clockwise rotation.

The operating-mode switchover unit 116 has a switching element 178, which is realized, for example, as a shift rod 180. The switching element 178 is guided, or mounted, in a linearly movable manner in a flange 182 (see FIG. 5). In the drilling mode, the axial movement capability of the switching element 178 is delimited, on a front side that faces toward the tool receiver 22, by a stop element 184 and, on a rear side that faces away from the tool receiver 22, by a switching device 186 of the switchover element 114. The switching device 186 is designed, in particular, to actuate the operating-mode switchover unit 116. The stop element 184 is arranged adjacently to an axial bearing 188 on the output shaft 120. The stop element 184 is realized, for example, as an annular disk element. In particular, the stop element 184 is fixedly connected to the output shaft 120.

The switching device 186 of the switchover element 114 has a first stop region 190 and a second stop region 192, which are connected to each other via a slope 194. The stop regions 190, 192 are substantially perpendicular to the work axis 24, or perpendicular to the linear degree of freedom of the switching element 178. The first stop region 190 is substantially parallel to the second stop region 192. The first stop region 190 of the switching device 186 has a lesser distance from the stop element 184 than has the second stop region 192 of the switching device 186. In particular, irrespective of the position of the drive shaft 112, the first stop region 190 has a lesser distance from the stop element 184 than has the second stop region 192. If the hand-held power tool 10 is bearing, with the insert tool, against the workpiece, or during the drilling operation, the output shaft 120, and the stop element 184 connected to it, is moved in the direction of the switching element 178, as a result of which the switching element 178, in turn, is moved in the direction of the switchover element 114, until the switching element 178 rests against, or acts upon, the first stop region 190 or the second stop region 192 of the switching device 186.

The switching element 178 is realized in such a manner that the switching element 178, when bearing against the first stop region 190 of the switching device 186, holds the output shaft 120 in an axial position in such a manner that the clutch 158 of the percussion-mechanism unit 140 is disengaged, and thus the percussion-mechanism unit 140 is switched off. In particular, in the hammer-drilling mode the output shaft 120 rests against the flange 182, and in the drilling mode rests against the switching element 178.

The switchover element 114 is mounted in the housing 12 of the hand-held power tool 10 so as to be rotatable about a switchover axis 196. In particular, the switchover element 114 encompasses the electric motor 20 in certain regions. The switchover axis 196 is, for example, coaxial with the motor axis 57. The switchover element 114 is arranged outside of a transmission space 200 that is spanned substantially by the flange 182 and the barrel-shaped transmission housing 81.

The switching element 178 is accommodated in a linearly movable manner in a receiver 202 of the flange 182. The receiver 202 has a cylindrical cross-section, which corresponds substantially to the cross-section of the switching element 178. The receiver 202 has a first opening 204, which connects the receiver 202 to the transmission space 200, and has a second opening 206, which connects the receiver 202 to a space outside of the transmission space 200. In order to ensure that no lubricant can escape from the transmission space 200 via the receiver 202, there is a sealing means 208 arranged in the receiver 202. In particular, the sealing means 208 is arranged, in the receiver 202, between the switching element 178 and the flange 182. The sealing means 208 is realized, for example, as an elastic plastic ring, or an O-ring. Advantageously, the switching element 178 has an annular groove 210 that is designed to receive the sealing means 208. Preferably, the annular groove 210 is always located within the receiver 202 of the flange 182, irrespective of the axial position of the switching element 178.

The switchover element 114 can be rotated about the switchover axis 196 as a result of an actuation of the operating element 112. In FIG. 7*a* the operating element 112 is in a middle position. In FIG. 7*a* the hand-held power tool 10 is in a drilling mode in clockwise rotation. Starting from the position shown in FIG. 7*a*, the switchover element 114 can be moved, by means of a first direction of actuation, into the position shown in FIG. 7*b*, in which the hand-held power tool 10 is in the drilling mode in anticlockwise rotation. Starting from the position shown in FIG. 7*a*, The switchover element 114 can additionally be moved, by means of a second direction of actuation, which is opposite to the first direction of actuation, into the position shown in FIG. 7*c*, in which the hand-held power tool 10 is in the hammer-drilling mode in clockwise rotation.

FIG. 7*b* shows a position of the switchover element 114 in which the hand-held power tool 10 is in a drilling mode in anticlockwise rotation. Moreover, the switching element 178 of the operating-mode switchover unit 116 is arranged between the first stop region 190 of the switching device 186 and the stop element 184, such that the percussion-mechanism unit is switched off.

The switchover element 114 has a further switching device 212, which is designed to actuate the rotational-direction switchover unit 118. The rotational-direction switchover unit 118 has a switching element 214 arranged in a rotatable manner on a housing of the operating switch 26. The switching element 214 is designed to be switchable between two different positions, the electric motor 20 in a first position being controlled in such a manner that the insert tool is driven in clockwise rotation. In the second position, the electric motor 20 is controlled in such a manner that the insert tool is driven in anticlockwise rotation. The switching element 214 has a flat plate region 216, from which a pin 218 extends upward.

The further switching device 212 is connected to the switching element 214. In particular, the further switching device 212 is realized as a guide gate 216, which is connected to the pin 218 of the switching element 214. In particular, the switchover element 114 is connected to the switching element 214 of the rotational-direction switchover unit 118 via the further switching device 212 in such a manner that a rotation of the switchover element 114 about the switchover axis 196 is converted into a rotational movement of the switching element 214 about a switching axis, the switching axis being substantially orthogonal to the switchover axis 196.

The guide gate 216 has two sub-regions 220, 222, which are connected to each other via an inclined recess 224. The sub-regions 220, 222 are realized, for example, as cutouts. In the transition between a position that corresponds to clockwise rotation (see FIG. 7*a*) and a position that corresponds to anticlockwise rotation (see FIG. 7*b*), the pin 218 of the switching element 214 is guided, along the inclined recess 224, from the second sub-region 222 into the first sub-region 220, causing a rotation of the switching element 214 about the switching axis, such that the switching element 214, or the pin 218, moves into the anticlockwise rotation position.

In the transition from the drilling mode in clockwise rotation (see FIG. 7*a*) to the hammer-drilling mode in clockwise rotation (see FIG. 7*c*), the switchover element 114 is rotated into a second direction of actuation that is opposite to the first direction of actuation. The further switching device 212, or the guide gate 216, is shaped in such a manner that the switching element 214 in this case substantially does not alter its position, and thus there is no switchover of the direction of rotation of the electric motor 20. In particular, the second sub-region 222 is shaped in such a manner that the pin 218 of the switching element 214 is not acted upon, or displaced, during this transition. There is thus no actuation of the rotational-direction switchover unit 118.

In contrast, there is an actuation of the operating-mode switchover unit 116. The switchover element 114 is moved in such a manner that the switching element 178 of the operating-mode switchover unit 116 is arranged axially between the second stop region 192 and the stop element 184. The distance between the second stop region 192 and the stop element 184 is selected in such a manner that the connection of the two clutch elements 160, 162 of the clutch 158 is not blocked by the switching element 178, such that the percussion-mechanism unit 140 can be activated.

The switchover device 113 furthermore has a safeguard element 226. The safeguard element 226 is realized, for example, as a single piece with the switchover element 114. The safeguard element 226 projects radially outward. The safeguard element 226 is arranged on the side of the switchover element 114 that faces toward the operating switch 26. In particular, the safeguard element 226 is arranged in such a manner that, upon actuation of the operating element 112, or of the switchover element 114, during operation of the hand-held power tool 10, the securing element 226 impinges on a corresponding securing element 228 and thus limits the rotation capability of the switchover element 114 during operation. The corresponding securing element 228 is connected, for example, to the actuating element 32 of the operating switch 26, in particular is realized as a single piece with it.

Figure 8:
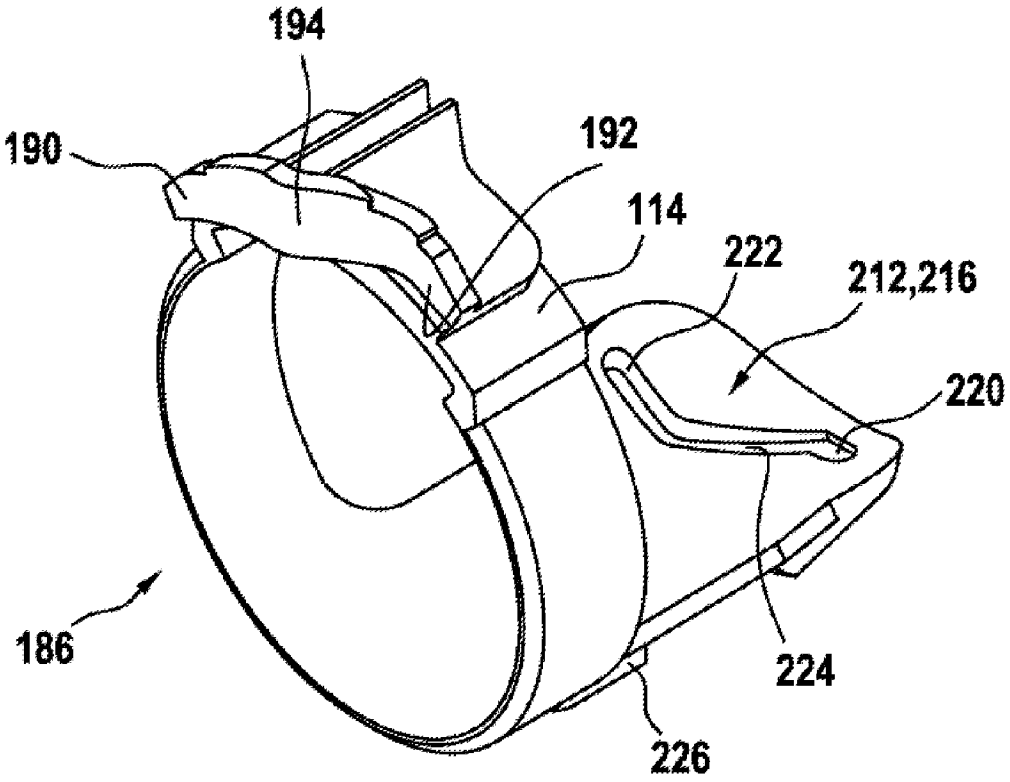
FIG. 8 a perspective view of a switchover element of the switchover device.

FIG. 8 shows a perspective view of the switchover element 114. The switching device 186 for actuating the operating-mode switchover unit 116 is arranged in a front, upper region of the switchover element 114, and the further switching device 212 for actuating the rotational-direction switchover unit 118 is arranged in a rear, lower region of the switchover element 114.

For the purpose of supporting the intermediate shaft 124, the hand-held power tool 10, in particular the flange 182, has a first radial bearing point 230 and a second radial bearing point 232, which can be seen in FIG. 5. The intermediate shaft 124 has a front end, which faces toward the tool receiver 22, and a rear end, which faces away from the tool receiver 22. Along the intermediate shaft 124, starting from the rear end, the first radial bearing point 230 is arranged in front of the first transmission 122, in particular in front of the second pinion element 128 of the first transmission 122. Also along the intermediate shaft 124, starting from the rear end, the second radial bearing point 232 is arranged in front of the second transmission 134, in particular in front of the first pinion element 136 of the second transmission 134. Advantageously, the second bearing point 232 is arranged between the first transmission 122 and the second transmission 134, enabling a particularly compact hand-held power tool 10 to be achieved.

The first radial bearing point 230 is realized, for example, as a journal bearing 234. The second radial bearing point 232 is realized as a wing bearing 236.

Figure 9:
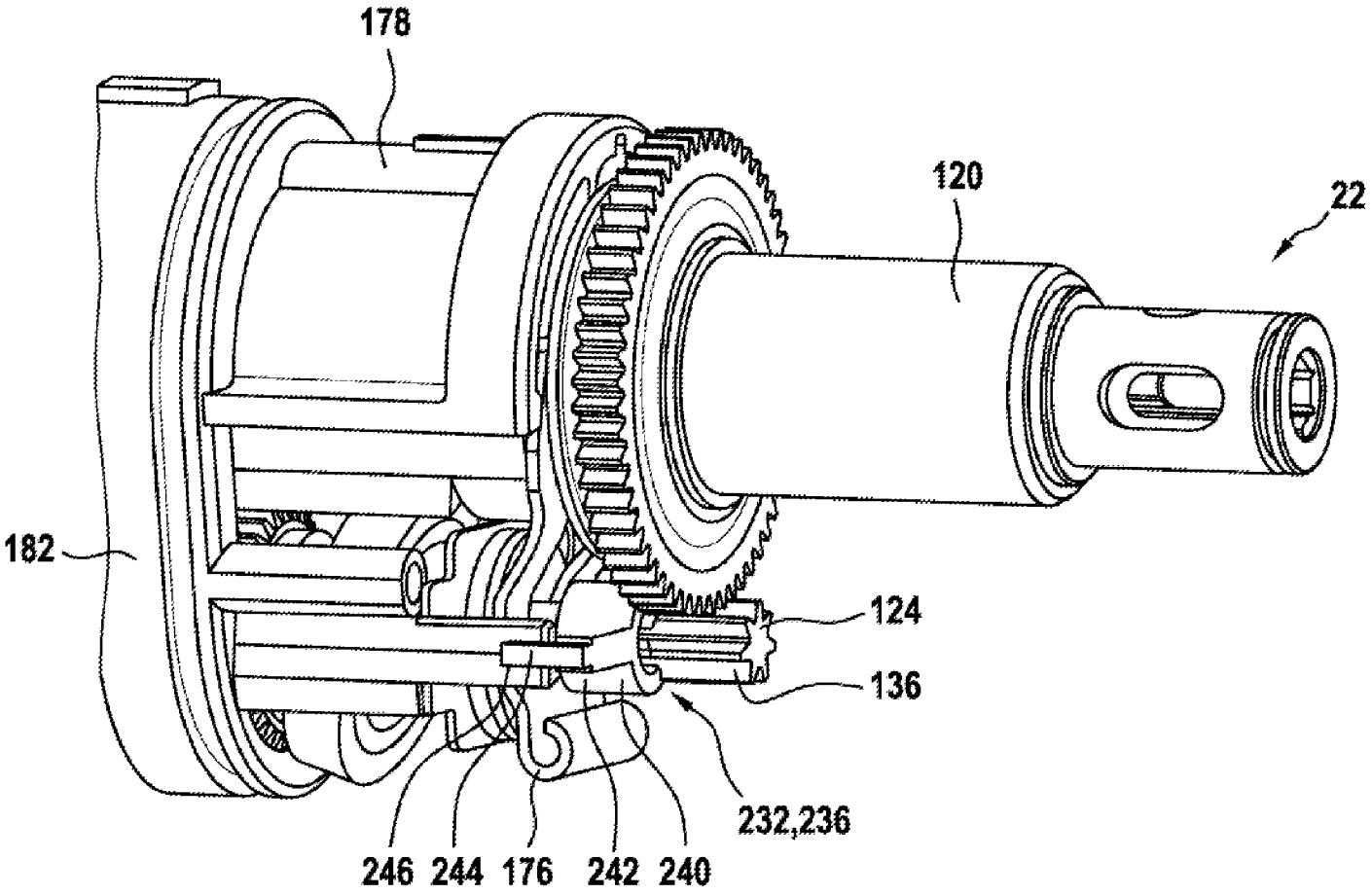
FIG. 9 a perspective view of a transmission unit of the hand-held power tool.

The wing bearing 236 is shown in a perspective view in FIG. 9, connected to the flange 182. The wing bearing 236 comprises a wing-bearing element 240. The wing-bearing element 240 has a hollow cylindrical main body 242. The hollow cylindrical main body 242 has an inner diameter that corresponds substantially to the outer diameter of the intermediate shaft 124, such that the wing-bearing element 240 can be pushed onto the intermediate shaft 124 for the purpose of assembly. For example, the wing-bearing element 240 is pushed on over the rear end of the intermediate shaft 124. Starting from the main body 242, the wing-bearing element 240 has at least one form-fit element, for example two form-fit elements 244, which are realized, in particular, as radially protruding arms. The flange 182 has form-fit elements 246, realized as grooves, which correspond to the form-fit elements 244 of the wing-bearing element 240 and via which the wing-bearing element 240 is connected in a force-fitting and/or form-fitting manner to the flange 182. Alternatively or additionally, it is also conceivable for the corresponding form-fit elements 246 to be arranged on the transmission housing 81, or to be realized as a single piece with it.

Figure 10:
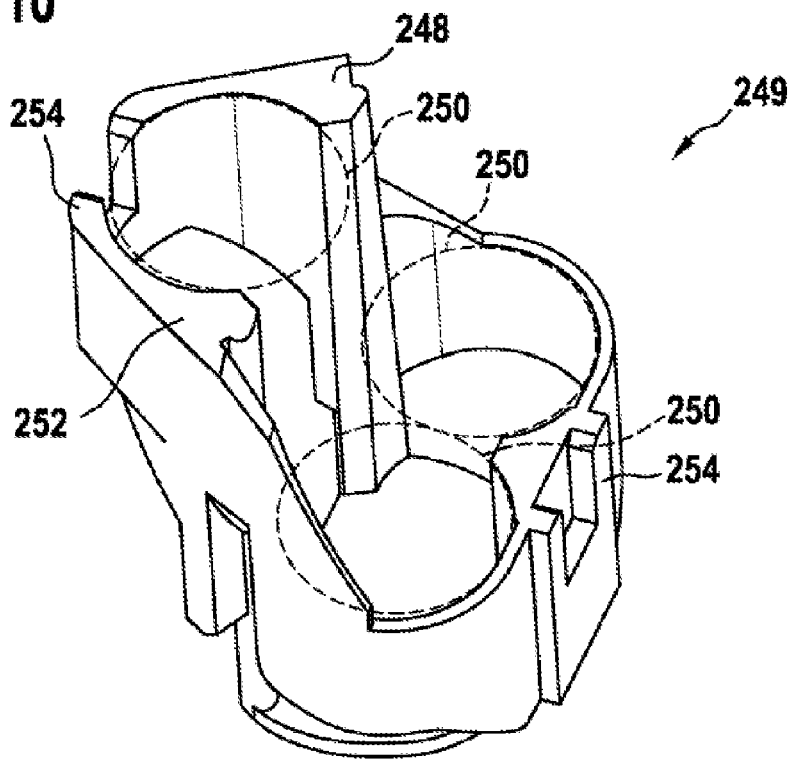
FIG. 10 a perspective view of a cell holder of the hand-held power tool.

FIG. 10 shows a perspective view of a cell holder 248. The cell holder 248 is designed to receive the battery cells 34 of the power supply 33. In particular, the cell holder 248 is realized as an assembly module 249, by means of which the fitting of the battery cells 34 in the hand-held power tool 10 is facilitated. In the assembled state, the cell holder 248 is accommodated completely in the housing 12 of the hand-held power tool 10. For each battery cell the cell holder 248 has a receiving region 250 that matches a shape of the battery cells 34, in particular a cylindrical shape of the battery cells. The cell holder 248 is made from a plastic material. The receiving regions 250 are realized in such a manner that the battery cells 34 are held in the receiving regions 250, at least partially, by a force fit. Alternatively, it would also be conceivable for the battery cells to be arranged loosely or with play in the receiving regions 250.

The cell holder 248 has a wall 252, on the inside of which the receiving regions 250 are arranged. Furthermore, the cell holder 248 has two fastening elements 254, one of the fastening elements 254 being realized as a cutout in the wall 252, and the other fastening element 254 being arranged on the outside of the wall 252. Alternatively, it would also be conceivable for the fastening elements 254 to be arranged only in the wall 252 or only on the outside of the wall 252.

The fastening elements 254 are realized as a single piece with the cell holder 248. The fastening elements 254 are designed to connect the cell holder 248 to the housing 12 of the hand-held power tool 10 in a force-fitting and/or form-fitting manner. The housing 12 of the hand-held power tool 10 has fastening elements 256 (see FIG. 2) corresponding to the fastening elements 254 of the cell holder 248. The force-fit and/or form-fit is effected between the fastening elements 254 of the cell holder 248 and the corresponding fastening elements 256 of the housing 12. The corresponding fastening elements 256 of the housing 12 are realized on an interior of the housing 12. The corresponding fastening elements 256 are preferably realized as a single piece with the housing 12. Advantageously, the fastening elements 256 of the housing 12 have two sub-pieces 258, which are arranged on two housing parts 67 that are to be joined together and that are realized, for example, as housing half-shell parts 68. Thus, advantageously, by means of the fastening elements 254 of the cell holder 248, the cell holder 248 is connected to the housing 12 of the hand-held power tool hand-held power tool 10, and the two housing half-shell parts 68 are connected to each other.

Figure 11:
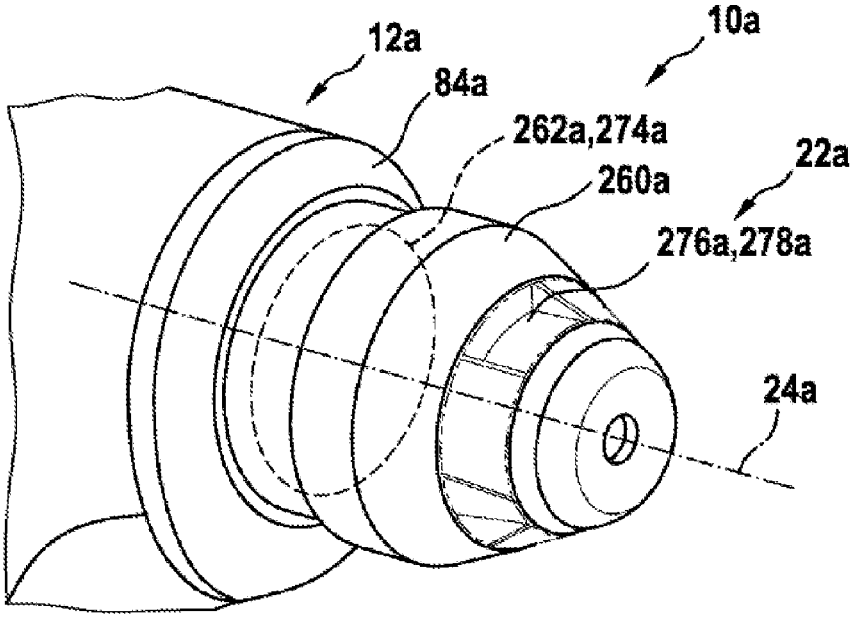
FIG. 11 a perspective view of an alternative embodiment of an illumination unit.
Figure 12:
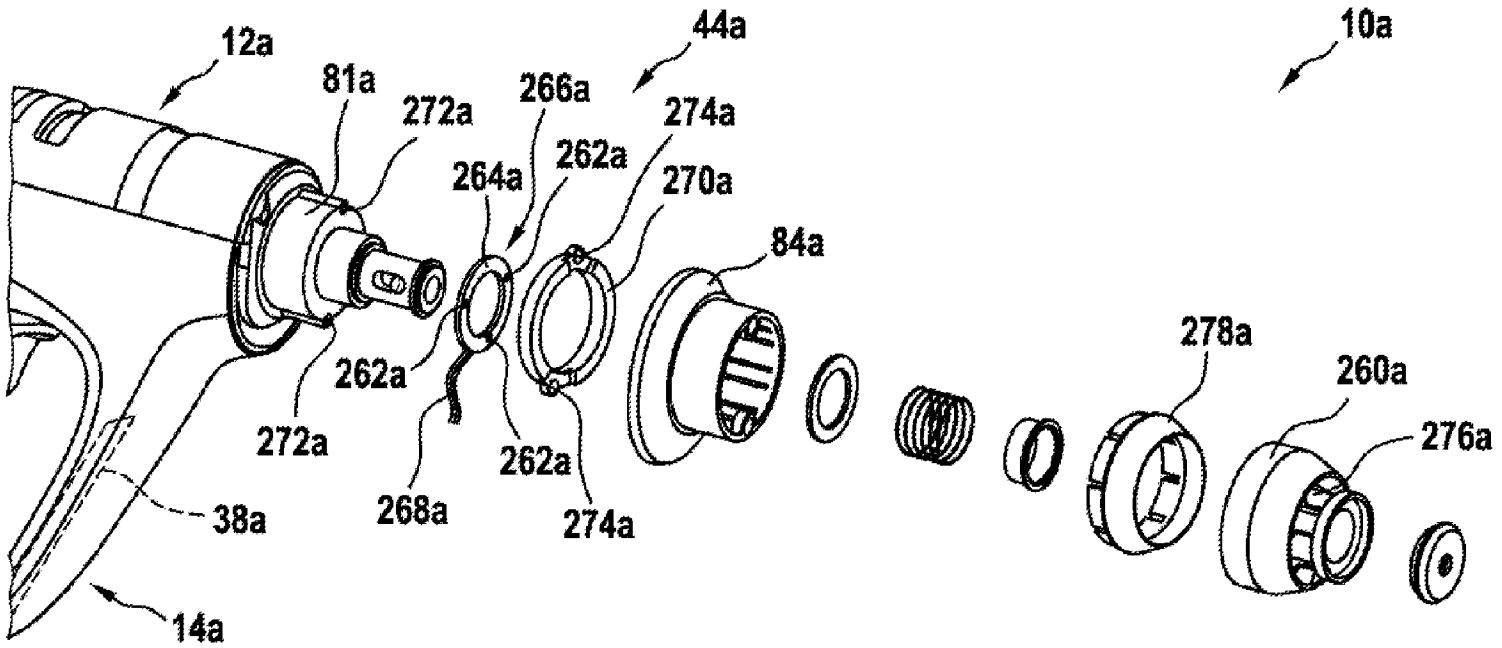
FIG. 12 an exploded view of the illumination unit according to FIG. 11.

FIG. 11 shows a perspective view of an alternative embodiment of the illumination unit 44 of the hand-held power tool 10. The hand-held power tool **10*a* corresponds substantially to the hand-held power tool 10 described previously. The illumination unit 44*a* is arranged in the region of the tool receiver 22*a*. FIG. 12 shows an exploded drawing of the illumination unit 44*a*. In the region of the tool receiver 22*a* the hand-held power tool 10*a* has a receiving sleeve 260*a*. The receiving sleeve 260*a* rotates about the work axis 24*a* during operation of the hand-held power tool 10*a*. Furthermore, the receiving sleeve 260*a* is mounted in an axially displaceable manner. In particular, the tool receiver 22*a* is realized in such a manner that a locking of an insert tool fastened in the tool receiver 22*a* can be released by an axial displacement of the receiving sleeve 260*a***.

The illumination unit **44*a* has three lighting elements 262*a*, which are realized, for example, as LEDs. The lighting elements 262*a* are arranged on a carrier element realized as a printed circuit board 264*a*. The printed circuit board 264*a* is assigned, in particular, to a further set of electronics 266*a* of the hand-held power tool 10*a*, the further set of electronics 266*a* having a computing unit, which is not represented in greater detail. Alternatively, however, it is also conceivable for the carrier element to be designed only to fasten the lighting elements 262*a*, and to connect the lighting elements 262*a* to the set of electronics 38*a* of the hand-held power tool 10*a*** via a cable connection, with no computing unit arranged on the carrier element.

The further set of electronics **266*a* is electrically connected to the set of electronics 38*a* of the hand-held power tool 10*a* that, as described previously, is arranged in the handle 14*a* of the hand-held power tool 10*a*. The electrical connection of the set of electronics 38*a* and the further set of electronics 266*a* is effected, for example, via a cable connection 268***a* that is routed between an exterior of the transmission housing 81*a* and an interior of the housing 12*a*.

The printed circuit board 264*a* is realized in the shape of a ring. The printed circuit board 264*a* is fastened, or fixed, to the transmission housing 81*a*, in particular to an exterior of the transmission housing 81*a*, of the hand-held power tool 10*a*. Alternatively or additionally, fastening to the housing 12*a* of the hand-held power tool 10*a* would also be conceivable. The fixing of the printed circuit board 264*a* to the transmission housing 81*a* is effected via a first light guide element 270*a*. The first light guide element 270*a* is composed of a transparent material, in particular of a transparent plastic material. The first light guide element 270*a* is realized in the shape of a ring. In the fixed state, the printed circuit board 264*a* is arranged between the transmission housing 81*a* and the first light guide element 270*a*, the first light guide element 270*a* being connected to the transmission housing 81*a*, in particular in a force-fitting and form-fitting manner, via a screw connection. The screw connection is effected by means of two screw bosses 272*a* in the transmission housing 81*a*, and by means of two circular cutouts 274*a* in the first light guide element 270*a*.

The lighting elements 262*a* and the first light guide element 270*a* are laterally enclosed by the housing 12*a* of the hand-held power tool 10*a*, in particular the front ring 84*a* of the housing 12*a*. The light emitted by the lighting elements 262*a* is thus guided to an interior of the receiving sleeve 260*a* without passing to the outside. The receiving sleeve 260*a* has a light conveying channel 276*a*, which is designed to guide the light outwards, in particular from an interior of the receiving sleeve 260*a* to an exterior of the receiving sleeve 260*a*. The light conveying channel 276*a* is realized, in particular, as a recessed space in the receiving sleeve 260*a*.

The illumination unit 44*a* has a second light guide element 278*a*. The second light guide element 278*a* is composed of a transparent material, in particular of a transparent plastic material. Preferably, the second light guide element 278*a* is composed entirely of a transparent material, such that the light is advantageously optimally distributed. The second light guide element 278*a* is connected to the receiving sleeve 260*a*, in particular connected in a force-fitting and/or form-fitting manner. The second light guide element 278*a* is realized substantially in the shape of a ring. The second light guide element 278*a* is arranged in the light conveying channel 276*a* of the receiving sleeve 260*a*. In particular, the second light guide element 278*a* is arranged in the light conveying channel 276*a* in such a manner that the light conveying channel 276*a* is sealed against the ingress of dust particles. The second light guide element 278*a* is thus realized so as to be movable relative to the lighting elements 262*a*, or relative to the first light guide element 270*a*.

The invention claimed is:

1. A switchover device for a hammer drill, comprising:

an operating-mode switchover unit;

a rotational-direction switchover unit; and a manually actuatable switchover element, configured to actuate the operating-mode switchover unit and the rotational-direction switchover unit, wherein the switchover element is rotatably mounted such that manual actuation of the switchover element rotates the switchover element about a switchover axis of the switchover element that is aligned with a direction of a work axis of the hammer drill, wherein the switchover element has a switching device configured to actuate a switching element of the operating-mode switchover unit, wherein the switching element of the operating-mode switchover unit is arranged in a transmission space of the hammer drill, in which a transmission unit of the hammer drill is arranged, and wherein the switching element is arranged in a receiving recess, and a sealing ring is arranged in the receiving recess so as to seal the switching element against the receiving recess and avoid the escape of lubricant from the transmission space via the receiving recess.

2. The switchover device as claimed in claim 1, wherein the switchover element is arranged, at least partially, on an upper side of the hammer drill, which is defined above a horizontal plane that passes through the work axis.

3. The switchover device as claimed in claim 1, wherein the switchover element is arranged outside of and/or at a distance from the transmission space.

4. The switchover device as claimed in claim 1, wherein the switchover element is mechanically coupled to the operating-mode switchover unit.

5. The switchover device as claimed in claim 1, wherein the switchover element is mechanically coupled to the rotational-direction switchover unit.

6. The switchover device as claimed in claim 1, wherein the switchover element has a further switching device configured to actuate the switching element of the rotational-direction switchover unit.

7. The switchover device as claimed in claim 6, wherein the switchover element, the switching device, and the further switching device are realized as a single piece.

8. The switchover device as claimed in claim 1, wherein:

the switchover device has a safeguard element configured such that movement of the safeguard element is coupled to movement of the switchover element, and the safeguard element is blocked by a corresponding securing element when an operating switch of the hammer drill is activated so as to prevent movement of the switchover element when the operating switch is activated.

9. A hammer drill comprising:

a switchover device comprising:

an operating mode switchover unit;

a rotational-direction switchover unit; and a manually actuatable switchover element configured to actuate the operating-mode switchover unit and the rotational-direction switchover unit;

a housing, in which an electric motor and a transmission unit are arranged, wherein a rotational drive motion of the electric motor is transmitted to a motor shaft that is connected to an intermediate shaft to transmit torque, the intermediate shaft being connected to an output shaft and a percussion-mechanism unit so as to transmit torque, wherein the switchover element is rotatably mounted such that manual actuation of the switchover element rotates the switchover element about a switchover axis of the switchover element that is aligned with a direction of a work axis of the hammer drill, wherein the switchover element has a switching device configured to actuate a switching element of the operating-mode switchover unit, wherein the switching element of the operating-mode switchover unit is arranged in a transmission space of the hammer drill, in which a transmission unit of the hammer drill is arranged, and wherein the switching element is arranged in a receiving recess, and a sealing ring is arranged in the receiving recess so as to seal the switching element against the receiving recess and avoid the escape of lubricant from the transmission space via the receiving recess.

10. The hammer drill as claimed in claim 9, wherein:

the hammer drill has at least three modes, which are switched via the switchover element, a first mode of the at least three modes is a hammer-drilling mode, a second mode of the at least three modes is a first drilling or screwdriving mode in clockwise rotation, and a third mode of the at least three modes is a second drilling or screwdriving mode in counterclockwise rotation.

11. The switchover device as claimed in claim 6, wherein the further switching device includes a guide gate configured to actuate the switching element of the rotational-direction switchover unit.

12. The switchover device as claimed in claim 1, wherein the switching element of the operating-mode switchover unit is arranged in a linearly movable manner in a receiving recess defined in a flange that defines the transmission space.

13. The switchover device as claimed in claim 1, wherein the transmission space is filled with lubricant and is sealed from remaining interior space of a housing of the hammer drill.

14. The switchover device as claimed in claim 1, wherein the switchover axis is parallel to the work axis of the hammer drill.

* * * * *